US009352866B2

(12) United States Patent
Takai et al.

(10) Patent No.: US 9,352,866 B2
(45) Date of Patent: May 31, 2016

(54) PACKING DEVICE OF TOFU

(75) Inventors: Toichiro Takai, Ishikawa (JP); Masahide Takeda, Ishikawa (JP); Kenji Honda, Ishikawa (JP); Toshio Hirata, Ishikawa (JP)

(73) Assignee: TAKAI TOFU & SOYMILK EQUIPMENT CO., Nonoichi-Shi, Ishikawa (JP)

( * ) Notice: Subject to any disclaimer, the term of this patent is extended or adjusted under 35 U.S.C. 154(b) by 883 days.

(21) Appl. No.: 13/524,710

(22) Filed: Jun. 15, 2012

(65) Prior Publication Data

US 2012/0317934 A1 Dec. 20, 2012

(51) Int. Cl.

| | |
|---|---|
| ***B65B 63/00*** | (2006.01) |
| ***B65B 35/36*** | (2006.01) |
| ***B65B 25/06*** | (2006.01) |
| ***B65B 5/06*** | (2006.01) |
| *B65B 39/00* | (2006.01) |

(52) U.S. Cl.

CPC ..... *B65B 35/36* (2013.01); *B65B 5/068* (2013.01); *B65B 25/06* (2013.01); *B65B 39/005* (2013.01)

(58) Field of Classification Search

CPC ..... B65B 5/062; B65B 5/068; B65B 5/08; B65B 5/105; B65B 5/108; B65B 25/06; B65B 35/36; B65B 39/005

USPC ..... 53/244, 246, 247, 248, 251

See application file for complete search history.

(56) References Cited

U.S. PATENT DOCUMENTS

| | | | | |
|---|---|---|---|---|
| 4,699,559 | A * | 10/1987 | Bibbo et al. | 198/428 |
| 5,303,531 | A * | 4/1994 | Senaratne | 53/448 |
| 2007/0119125 | A1* | 5/2007 | Stenbom | 53/473 |
| 2011/0023417 | A1* | 2/2011 | Finkowski et al. | 53/443 |

FOREIGN PATENT DOCUMENTS

| | | | |
|---|---|---|---|
| JP | H07-95927 | B2 | 10/1995 |
| JP | 3343134 | B2 | 8/2002 |
| JP | 2007-006759 | A | 1/2007 |

OTHER PUBLICATIONS

Machine Translation of JP-3343134; Date Retrieved: Dec. 24, 2014; 11 pages.*

* cited by examiner

*Primary Examiner* — Thanh Truong
*Assistant Examiner* — Dianne Mitchell
(74) *Attorney, Agent, or Firm* — Manabu Kanesaka

(57) ABSTRACT

A tofu packing apparatus for packing plural tofu blocks in individual packs for sales includes a conveyor for conveying the plural tofu blocks cut to a predetermined size and arrayed at predetermined intervals, and a paired grasp plates be driven in the direction to approach each other. The tofu blocks cut to a predetermined size are grasped with the paired grasp plates, moved to predetermined positions above packaging packs conveyed to predetermined positions with the packaging pack conveyance apparatus, and dropped and packed in the packaging packs through release of grasp by the paired grasp plates. The tofu blocks may be dropped and housed in the packaging packs while at least maintaining the tofu blocks in a holding state by the paired grasp plates.

9 Claims, 24 Drawing Sheets

Orthogonal arrangement
& width direction grasp

Zigzag alignment 1
& width direction grasp

Zigzag alignment 2
& width direction grasp

Orthogonal arrangement
& travelling direction grasp

Zigzag alignment 1
& travelling direction grasp

Orthogonal arrangement
& width direction grasp

Zigzag alignment 1
& width direction grasp

Zigzag alignment 2
& width direction grasp

Orthogonal arrangement
& travelling direction grasp

Zigzag alignment 1
& travelling direction grasp

Orthogonal arrangement
& division & two-way and four-way grasps

Zigzag alignment & division
& two-way and four-way grasps

PACKING DEVICE OF TOFU

TECHNICAL FIELD

The present invention relates to a packing device of tofu sharing in a step for packing, in packaging packs in form of selling, blocks of tofu cut to have a predetermined size in an automatic tofu production line and particularly to a packing device of tofu that performs tofu packing onshore.

BACKGROUND ART

An automatic production line of tofu, the materials of which are soybeans, is a huge processing apparatus mechanically connecting via a conveyance line various kinds of apparatus sharing in various steps from the materials up to tofu products packaged in form of selling.

In the automatic tofu production line, various apparatus sharing in various kinds of steps different in processing content are connected in series. In addition, the processing contents the individual connected apparatus take care of fall in various kinds of fields, and the steps different in processing difficulty are mixed.

One of the steps high in processing difficulty in the automatic tofu production line is a step of packing tofu. The methods of packing tofu include the method performing the step in an onshore space ("onshore filling") and a method performing the step in water. The method of performing the packing work in the space that is so-called "onshore filling" (also called "hill filling) is disclosed in Japanese Patent No. 3343134 C (Patent Document 1) and comprises combining a conveyor for conveying blocks of tofu and a pack conveyor for supplying packaging packs in an intersecting direction, moving the blocks of tofu from the terminal of the conveyor to a shutter plate with companies' own devices (a feed blade plate, for example), pressing the blocks of tofu against a stopper plate to position the blocks of tofu on the packaging packs on the pack conveyor, and retracting the shutter plate to drop the positioned blocks of tofu on the packaging packs.

In addition, JP 2007-006759 A (Patent Document 3) discloses the steps of feeding blocks of tofu on an inclined chute, aslant dropping the blocks of tofu to house the blocks of tofu in going-with operating packaging packs.

On the other hand, the method of packing blocks of tofu in water is a polite method conforming to a traditional manual work and a method of precisely cutting the blocks of tofu without injuring the same and accurately housing the blocks of tofu in packaging packs. In addition, JP H7-95927 B (Patent Document 2) discloses a method adopted focusing the advantage capable of treating the blocks of tofu while diminishing the weight of the blocks of tofu during being treated by exerting buoyancy on the blocks of tofu and comprising the steps of introducing a pack conveyor in a water tank, dispensing the blocks of tofu cut in water correspondingly to the conveyance interval of the supplied packs, positioning the dispensed individual blocks of tofu with a positioning device exercising its own ingenuity, then releasing the blocks of tofu, housing the blocks of tofu in the packs so as to skim the blocks of tofu in the packs and sending out the housed blocks of tofu out of the water tank.

Patent Document

Patent Document 1 is JP 2007-006759 A
Patent Document 2 is JP H7-95927 B
Patent Document 3 is JP 2007-006759 A

DISCLOSURE OF THE INVENTION

Problems the Invention Intends to Solve

In the meantime, in the automatic continuous production line capable of mass production of tofu, the onshore filling method is effective in the packing step that is a rate-limiting step of the automatic tofu production line as described in Patent Document 1 and Patent Document 3. It is important to eliminate tofu damage and any loss and heighten the processing capacity in the step of onshore packing the blocks of tofu cut into the predetermined size in the packaging packs in form of selling. Particularly, even when there has/have been one or more steps or gaps in transferring fresh and fluffy soft blocks of tofu from the tofu conveyance line to the packaging pack conveyance line, it is necessary to move the blocks of tofu without being damaged and accurately house the same in the packaging packs. In addition, when housing the blocks of tofu in the packaging packs through dropping, it is necessary to accurately position the blocks of tofu temporarily above the packaging packs at first before being housed.

In addition, in an underwater packing method in which operations of the blocks of tofu and all members handling the blocks of tofu are performed in water, the blocks of tofu are affected by water resistance and inducing turbulence. Even when tofu is sunk by its own weight on the bottom of the packaging pack filled fully with water and filled or the tofu is housed by pressing so as no to break tofu, it takes much time to house the tofu in the pack due to the water resistance. Therefore, the processing capacity of the packing step has its own limits and it is difficult to speed up the automatic tofu production line. Though countermeasures have been taken to solve the problem of the water resistance (refer to Patent Document 2), it is basically difficult to solve the problem of speeding-up the automatic tofu production line. On the other hand, as regards the "onshore filling" method for the blocks of tofu (refer to Patent Document 1), since tofu receives no water resistance, the automatic tofu production line can be speeded up. To do so that restricts the line speed of the entire automatic tofu production line and, at the same time, accurately position the blocks of tofu relative to the packaging packs onshore without breaking the blocks of tofu and house the blocks of tofu in the packaging packs.

In the conventional packing apparatus adopting "onshore filling" method (refer to Patent Document 1), a slide table is disposed in form of extending a conveyor belt of a conveyance line conveyor for conveying the blocks of tofu above a pack conveyor for concretely supplying the packaging packs, and a stopper is disposed on the slide table in order to position the blocks of tofu. In addition, a feed blade horizontally moving along the conveyor belt surface of a supply conveyor is disposed on the conveyance line conveyor. The tofu blocks on the conveyor belt are pushed in one row unit with the feed blade from the upstream to downstream side. The one row of tofu blocks slides on the conveyor belt to reach on the slide table and collides against the stopper to stop. At this time, the tofu blocks are in a temporary state grasped between the feed blade and the stopper in the longitudinal direction. Thereafter, the slide table in a state supporting the tofu blocks thereon retracts so as to be pulled out in the downstream side and, as a result, the tofu blocks drop in the packaging packs positioned beforehand below the slide table. The whole pack conveyor can move up and down with an elevating mechanism and, at the time of dropping the tofu blocks, moves up, thereby shortening the dropping distance of the tofu blocks.

In the conventional packing apparatus, since accurate positioning cannot be established because it is very difficult to take the timing of retracting the slide table and moreover it has been likely that the step of pushing and feeding the tofu blocks with the feed blade has already produced subtle position aberration, it is not stable to house the tofu blocks in the packaging packs. In addition, when it is tried to send out soft tofu rapidly only with the feed blade, the tofu is damaged. Therefore, it is only possible to send out the tofu blocks slowly. For this reason, the packing apparatus can only apply to the tofu housing processing in one row unit and has its own limits, specifically the production capacity of 2000 to 3000 blocks of tofu per hour at most.

In view of the above, an object of the present invention is to provide an apparatus for packing tofu blocks onshore without damaging the plenty of tofu blocks conveyed with a conveyor without using the conventional slide table or slide shooter or through housing the tofu blocks in packaging packs more accurately even when the table or shooter has been used. Another object of the present invention is provide an apparatus for packing tofu blocks capable of dramatically heighten the packing processing capacity through concurrently grasping plural rows of tofu blocks arranged on the conveyor in a width direction as many as possible and concurrently housing the tofu blocks in the packaging packs.

SUMMARY OF THE INVENTION

To accomplish the above object, the present invention provides a tofu packing apparatus for packing onshore plural tofu blocks in individual packs in form of selling, comprising a conveyor for conveying the plural tofu blocks cut to a predetermined size and arrayed at predetermined intervals, a packaging pack conveyance apparatus for conveying packaging packs to a position of a downstream end of the conveyor, and a grasp drive mechanism equipped with paired grasp plates openably and closably driven, whereby the tofu blocks on the conveyor are grasped with the grasp drive mechanism equipped with the pair of grasp plates, moved to predetermined positions above the packaging packs conveyed to predetermined positions with the packaging pack conveyance apparatus and dropped and packed in the packaging packs through release of grasp by the paired grasp plates or whereby the tofu blocks are dropped and housed in the packaging packs, with at least a packed state by the paired grasp plates maintained.

The present invention provides a tofu packing apparatus for packing onshore plural tofu blocks in individual packs in form of selling, comprising a conveyor for conveying the plural tofu blocks cut to a predetermined size and arrayed at predetermined intervals, a packaging pack conveyance apparatus for conveying packaging packs to a position of a downstream end of the conveyor, a grasp drive mechanism equipped with paired grasp plates openably and closably driven, and a shutter plate disposed at a position approximate so as to extend a conveyance surface to the downstream end of the conveyor for bringing into sight or blocking the packaging packs disposed below the conveyance surface, whereby the tofu blocks on the conveyor are grasped with the grasp drive mechanism equipped with the pair of grasp plates, conveyed from the conveyor onto the shutter plate and positioned via the shutter plate above the packaging packs conveyed to predetermined positions with the packaging pack conveyance apparatus and, in conjunction with releasing operation of the shutter plate above the packaging packs, the paired grasp plates are released to drop and house the tofu blocks in the packaging packs or whereby the tofu blocks are dropped and housed in the packaging packs, with at least a packed state by the paired grasp plates maintained.

According to the present invention, does not need a shutter plate basically in packing ordinary tofu blocks because the presence of the shutter plate increases a drive member or parts, requires time to perform its operation step even slightly and affects the processing capacity. However, in the case of needing more accurate positioning or tackling the problem of extremely soft tofu blocks unsuitable for high-speed operation, it is preferred that the shutter plate is used together. Furthermore, in the present invention, since the step of simultaneous grasping plural rows of tofu blocks which has not heretofore been taken and the step of high-speed or high-acceleration operation that is extremely high in difficulty are considered, the apparatus needs addition of operational degree of safety. It can also be decided whether or not the shutter plate is used depending on the kind of tofu blocks (cotton tofu, silken tofu, soft tofu like pudding, etc.). Furthermore, by adopting the shutter plate and using a pair of grasp plates together, the tofu blocks can be positioned and it is possible to establish accurate tofu dropping timing and drop tofu blocks all together. That is to say, the adaptability relative to the kind of tofu blocks and both the infallibility and the safety in the case of simultaneously grasping plural rows of tofu blocks can be heightened.

According to the present invention, in housing the tofu blocks in the packaging packs, the tofu blocks may drop through release of the grasp plate at a position above the packaging packs. However, it may be adopted that the tofu blocks are inserted in the packaging packs along with the pair of grasp plates and allowed to drop through release of the grasp plates or that the tofu blocks are inserted onto the bottoms of the packaging packs and housed in the packaging packs through release of the grasp plates. In the case of inserting the tofu blocks together with the pair of the pair of grasp plates in the packaging packs, the grasp plates (including a spacer plate described later) have sections of smaller width than the inner dimension of the packaging packs.

In addition, in the present invention, it is referred to completely release the grasp by the pair of grasp plates. However, the tofu blocks may be allowed to drop and housed in the packaging packs while retaining the state not releasing the grasp. That is to say, preferably through slightly weakening the grasping force or slightly opening between the pair of grasp plates, the grasped tofu blocks are allowed to slip off between the pair of grasp plates. In this case, since the pair of grasp plates function as guides for the tofu blocks being allowed to drop and housed in the packaging packs and also function as brakes for suppressing the dropping speed of the tofu blocks, it is possible to drop-house (or slip-drop-house) the tofu blocks in the packaging packs more accurately.

In the present invention, a grasp drive mechanism equipped with the pair of grasp plates and functioning as means for transferring the tofu blocks from the conveyor onto the packaging pack conveyance apparatus conveys the tofu blocks, with one or plural rows of tofu blocks arranged in the width direction, for example, of the conveyor grasped in the longitudinal direction (respective two surfaces of the tofu blocks on the upstream and downstream sides from two directions), or with one or plural rows of tofu blocks arranged in the width direction of the conveyor grasped in the lateral direction (respective two surfaces of the right-and-left sides of the tofu blocks from two directions). The tofu blocks in the state grasped with the pair of grasp plates exhibit less deformation or position aberration than in the conventional case of merely pushing the tofu blocks from one direction and are less likely to induce swell by push induced at the time one-direction push and sending. Thus, the tofu blocks are suppressed from deformation and, therefore, the pair of grasp plates can be driven at a high speed. Since the contact-pressure eccentrically-located state is less likely to occur between the back surfaces of the tofu blocks and the belt surface of the conveyor, a water film generally formed on the conveyor belt surface can be utilized as a lubricant to prevent the tofu blocks from being damaged even in a high-speed conveyance, thereby enabling the tofu blocks to be accurately positioned at the predetermined position through the predetermined distance movement of the tofu blocks on the conveyor belt, transfer plate or shutter plate. In addition, the water film absorbs impacts of contact and separation generated at the time of grasp or release thereof when the tofu blocks are grasped with the pair of grasp plates, prevents the tofu blocks from being damaged and serves to smoothly aid the contact and separation. Further, when the surfaces of the tofu blocks have been in intimate contact with the surfaces of the pair of grasp plates through the water film, the respective adsorption forces are generated by the action of surface tension to aid the grasping force by the grasp plates and, therefore, the tofu blocks have an effect of preventing their dropping.

According to the present invention, even when there is a step in the traveling direction, the tofu blocks in a state grasped between the pair of grasp plates can overleap the step unlike in the conventional case of merely pushing the tofu blocks in one direction. In addition, when the tofu blocks are drop-housed in the packaging packs, since the state grasping the tofu blocks can be retained as long as possible, the tofu blocks are accurately drop-housed (drooped) in the packaging packs.

In addition, even in the case of using the shutter plate, while maintaining the grasping state by the pair of grasp plates until retracting the shutter plate, the tofu blocks are allowed to slip off between the pair of grasp plates and drop-housed or slip-drop-housed in the packaging packs, or the tofu blocks are drop-housed in the packaging packs through releasing the grasp by the pair of grasp plates after retracting the shutter plate. Therefore, the present invention eliminates the conventional tofu bend and inclined tofu drop housing, and reduces the bend and inclination as much as possible to enable substantially horizontal posture dropping and dropping in a drooped state.

According to the present invention, a tofu packing apparatus, wherein the packaging packs are conveyed in a direction orthogonal to the conveyor with the packaging pack conveyance apparatus to predetermined positions in an array of N rows and/or M columns and wherein the tofu blocks are grasped with the paired grasp plates in a width direction and conveyance direction in an array of M rows and/or N columns in conformity with the array of the packaging packs and conveyed to the predetermined positions above the packaging packs. The present invention, M is a natural number, and N is a natural number. Thus, M≥=1, and/or, N≥1.

According to the present invention, a tofu packing apparatus, wherein the paired grasp plates has at least one spacer plate therebetween, and the tofu blocks are grasped in a unit of M rows and/or in a unit of N columns with the paired grasp plates having the spacer plate.

According to the present invention, a tofu packing apparatus, wherein the paired grasp plates comprise plural sets of paired grasp plates, and the tofu blocks are grasped in a unit of M rows and/or in a unit of N columns with the plural sets of paired grasp plates.

In the present invention, the pair of grasp plates having the spacer plates makes it possible to grasp the tofu blocks all together in the unit of plural rows and/or the unit of plural columns. Preferably, the spacer plate is a member (square pipe or member of an H shape or channel shape open at the left, in cross section) having a width in accordance with a distance between rows of the tofu blocks conveyed to the predetermined position from the packaging pack conveyance apparatus. In addition, the packaging pack conveyance apparatus comprises N rows and M columns of apparatus the same as M rows and N columns of tofu blocks grasped with the pair of grasp plates, with the conveyance direction of the pack conveyor conforming to the width direction or traveling direction of the conveyor (or M rows and N columns of apparatus in the case where the pack conveyance direction is the same as the traveling direction of the conveyor). Before the tofu blocks are grasped with the pair of grasp plates in conformity with the interval between the packaging packs in the column direction (traveling direction of the pack conveyor) of the tofu blocks conveyed to the predetermined position, the tofu blocks are widened at predetermined intervals in the row direction (width direction of the pack conveyor) with a cutting alignment apparatus, is preferably. According to the present invention, a tofu packing apparatus, which is composed (as multi-barreled) arranged in multiple columns on the conveyor with a column spacing of the pack according to the distance between the lines of group packaging tofu is preferably. According to the present invention, on the front of the tofu packing apparatus, on the pack conveyor wherein a pack supply device to supply a pack automatically high-speed in the conveyor frame. The present invention, M≥1, and/or, N≥1. According to the present invention, a tofu packing apparatus, width direction of the packaging packs conveyed and conveyance direction are same direction, M≥2, and, N≥1, is preferably. According to the present invention, a tofu packing apparatus, traveling direction of the packaging packs conveyed and conveyance direction are same direction, M≥1, and, N≥2, is preferably. According to the present invention, enhance the packing capacity to a great extent through the steps of grasping, as nipping, the tofu blocks on the conveyor belt with the pair of grasp plates, moving the tofu blocks arranged on the conveyor belt of the conveyor onto the packaging packs supplied with the pack conveyor to attain positioning. In the present invention, tofu packing processing capacity is M times, or N times.

In the present invention, a tofu packing apparatus for packing onshore plural tofu blocks, comprises a grasp drive mechanism equipped with paired grasp plates openably and closably driven, whereby the tofu blocks on the conveyor are grasped with the grasp drive mechanism equipped with the pair of grasp plates, operating at anteroposterior row unit, or operating at anteroposterior row unit, or left-right column unit. Moreover, plural grasp drive mechanisms are equipped with paired grasp plates openably and closably driven. In addition, it may be a plate member corresponding to each of the tofu blocks, in order to give positioning accuracy. A tofu block, well to grip form from two-way, may be in the form of left and right sides to grip from before and after.

According to the present invention, a tofu packing apparatus, wherein the tofu blocks are grasped with the paired grasp plate once the conveyor is stopped, then the conveyor is driven to operate the paired grasp plates in synchronization or conjunction with the driven conveyor, thereby moving the tofu blocks onto the packaging packs conveyed to the predetermined positions or onto the shutter plate. According to the present invention, a tofu packing apparatus, which is composed (as multi-barreled) arranged in multiple columns on the conveyor without a column spacing of the pack is possible. Two units of pair-grasp plates grasp tofu blocks at once is possible. In case of M rows, maximum spacer plate number is less than M rows, M−1. In case of N rows, maximum spacer plate number is less than N columns, N−1. According to the present invention, a tofu packing apparatus, wherein the paired grasp plates has one spacer plate therebetween, and the tofu blocks are grasped in a unit of two or more rows and/or in a unit of two or more columns with the paired grasp plates having the spacer plate, is preferable. According to the present invention, a tofu packing apparatus, whereby the tofu blocks are dropped and housed in the packaging packs at once is preferable.

According to the present invention, a tofu packing apparatus, wherein the package pack conveyance apparatus comprises a pack conveyor that supports flange portions of the packaging packs, with bottom surfaces of the packaging packs exposed, and a knocking-up mechanism disposed below the pack conveyor, the knocking-up mechanism knocks up the bottoms of the packaging packs supplied to the predetermined positions with the pack conveyor or knocks up the pack conveyor from below to float the packaging packs and cause the packaging packs to approximate the tofu blocks to be grasped with the paired grasp plates or, via the shutter plate, cause the packaging packs to approximate the tofu blocks to be grasped with the paired grasp plates. In the present invention, the distance is shortening between the shutter and the packaging packs and the dropped tofu blocks is reduced a dropped damage.

In the present invention, water exists as a lubricant, between the underside of tofu and paired grasp plates, and before the shutter plate storage to pack packaging, reducing the external force or grip the plate extends to a tofu so that the tofu is more reliable and stable. The shutter plate above may be in the form that is configured in multiple sheets form and the form and one plate is round trip from side to side before and after, the two plates to open and close from side to side around each other, like the shutter of the camera, is possible. The shutter plate is consisting of a sheet, two sheets, or four sheets. The one sheet as the support shaft side, close in the horizontal position, in the open position about 30 to 90°, so as to direct the opening of the pack to packaging, or packaging inscribed on the inside of the pack at the bottom, dropping also serves as a good guide to guide a tofu or shoot a tofu. In the invention, stuffed pack is less clearance of tofu packs and packaging is possible, that can hold the tofu acts like a "shoehorn" is the shutter plate above also very close to the inside dimension pack packaging dimensions. And, possible to suppress the flavor missing in the gap can reduce the water pack tofu. Thus, the feeling of luxury products and an image was carefully hand-made is possible.

Effects of the Invention

According to the present invention, a tofu packing apparatus, it is possible to attain packing the twice packing capacity (5,000 to 8,000 tofu blocks/hour) to severalfold packing capacity (10,000 to 36,000 tofu blocks/hour in comparison with the conventional process of packing one column of tofu blocks each time (2,000 to 3,000 tofu blocks/hour) because the tofu blocks arranged in plural lines and plural columns with the spacer plate interposed between the pair of grasp plates are grasped at a time, allowed to float on the conveyor or slide on the conveyor and housed at a time in the packaging packs. Furthermore, the tofu blocks are grasped by a uniform and minimum force with the pair of grasp plates as nipping the tofu blocks on the conveyor belt and suppressed and controlled in dropping with the grasp plates without damaging the tofu blocks, thereby enabling accurate packing with high processing capacity per hour. As a result, speeding up of the whole continuous tofu production line, which has not been realized because the step of packing the tofu blocks is the rate-limiting step, can be attained. Moreover, by using a retractable shutter plate and pack conveyor knocking-up mechanism together, it is enabled to perform further accurate and high-speed packing.

DETAILED DESCRIPTION OF THE INVENTION

Embodiments of a tofu packing apparatus according to the present invention will be described hereinafter with reference to the accompanying drawings.

First Embodiment

Figure 1:
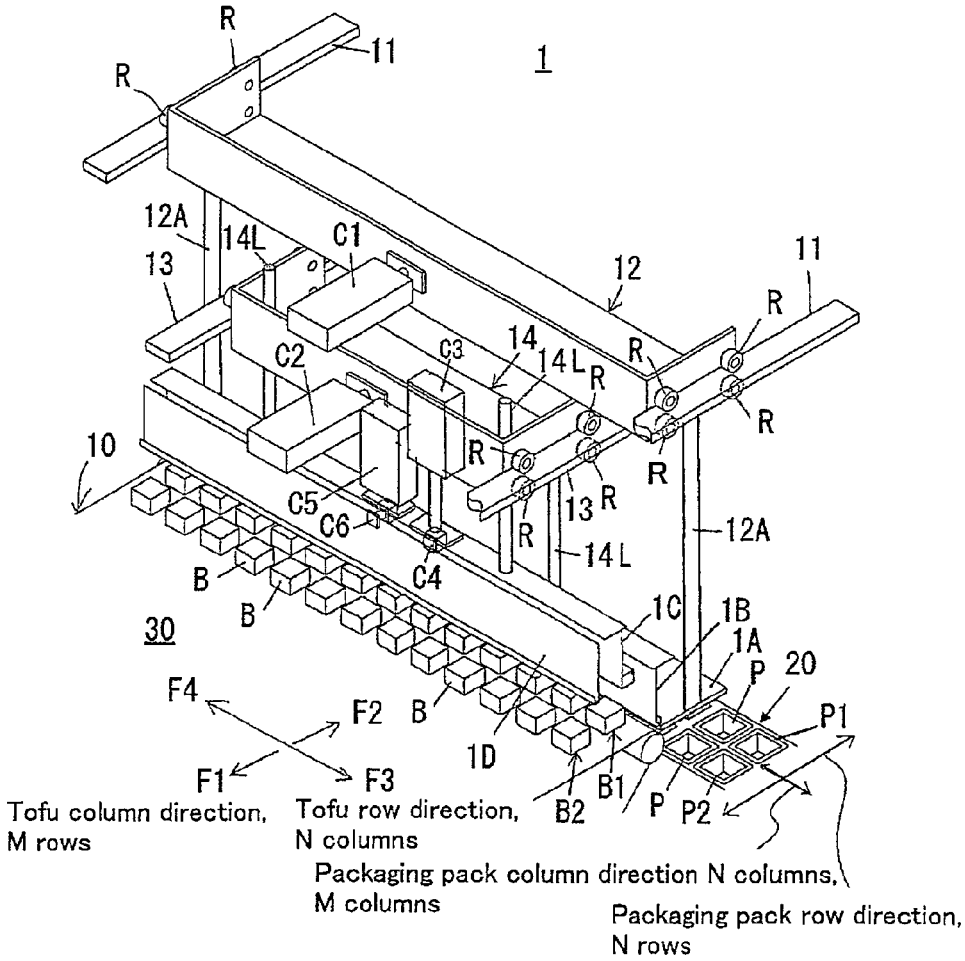
FIG. 1 is a perspective view showing a tofu packing apparatus according to the first embodiment of the present invention.
Figure 2:
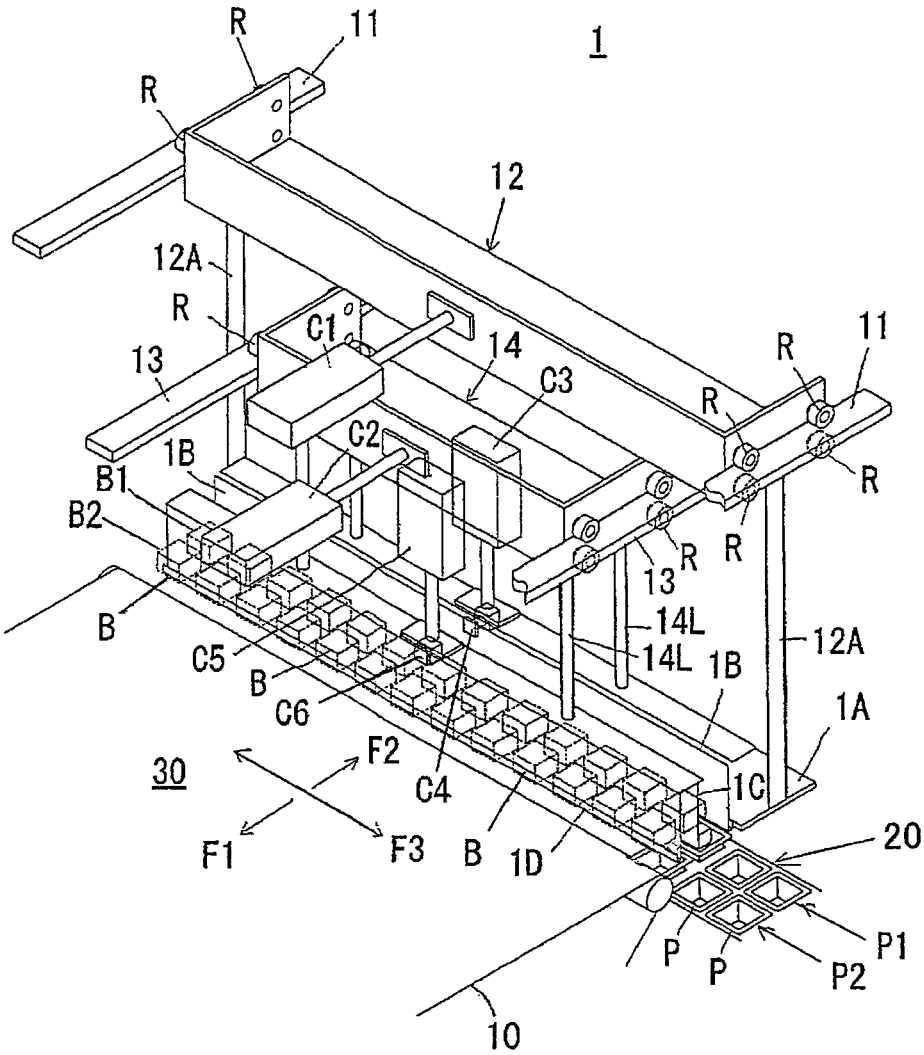
FIG. 2 is an explanatory view showing an operation of the tofu packing apparatus.

FIG. 1 and FIG. 2 show the same packing apparatus 1 for packing two rows of tofu blocks, and FIG. 2 shows a state assumed after the packing apparatus 1 shown in FIG. 1 has performed a specific motion to be described later. The tofu packing apparatus 1 comprises a conveyor for conveying tofu blocks B cut to a predetermined dimension, a pair of grasp plates 1B and 1D for operating the tofu blocks B, a grasp drive mechanism 40 for driving and controlling a spacer plate 1C, and a packaging pack conveyance apparatus 20 for supplying to a packing position packaging packs P for housing the tofu blocks cut to the predetermined size. In the following embodiment, as shown in FIG. 1 or FIG. 2, an example will be described where the tofu blocks B are cotton tofu blocks of approximately 70 mm×70 mm×30 mm and two rows of tofu blocks in the width direction of the conveyor 10 and 13 columns of tofu blocks in the traveling direction thereof are packed in the packaging packs P all together as a unit. In the present invention, it is preferred that the numbers of the tofu blocks B and packaging packs P are optional such that M rows are adopted in the width direction of the conveyor 10 and N columns are adopted in the traveling direction thereof, in which preferably $1 \leq M \leq 10$ and $1 \leq N \leq 100$ (each of M and N is a natural number). Actually, however, in consideration of the various conditions including the product dimension, product quality (hardness), installation area and mechanical dimension of the conveyor, and desirable processing capacity, it is preferred that $2 \leq N \leq 5$ and $2 \leq M \leq 60$ (each of M and N is a natural number) as an example easy to perform. It is preferred that a tofu block has a shape of cube (regular hexahedron) or rectangular parallelepiped having a side of 20 to 150 mm and height of 10 to 100 mm, preferably a side of 50 to 150 mm and a height of 20 to 80 mm. In addition, the break force of tofu is 0.2 to 20 $N/m^2$ (about 20 to 2,000 $gf/cm^2$) and, in consideration of the nipping property and texture, preferably 0.4 to 10 $N/m^2$ (approximately 40 to 1,000 $gf/cm^2$). Tofu to be packed in the present invention is ordinary cotton tofu, silken tofu or soft tofu like pudding.

The tofu blocks B pass through the cutting alignment apparatus disposed on an upstream side F1 of a conveyor belt 30, dispensed onto the conveyor belt 30 in a state orderly arranged longitudinally and laterally and conveyed on a downstream side F2 in accordance with intermittent or continuous drive of the conveyor belt 30. The conveyor 10 is disposed near the terminal end of the conveyor belt 30, and the packaging pack conveyance apparatus 20 is disposed near the terminal end of the conveyor belt 30 at a lower position in width directions F3 and F4 of the conveyer belt 30, i.e. in the direction intersecting the conveyor belt 30. Though not shown, in the previous process of conveying the tofu blocks B on the conveyor belt 30, since the tofu blocks B are taken out of the water tank and conveyed on the conveyor belt 30, sufficient water droplets adhere to the tofu blocks B. Incidentally, water-sprinkling means may be disposed on the conveyor belt 30 in order to allowing water droplets to sufficiently adhere to the tofu blocks B.

Figure 6A:
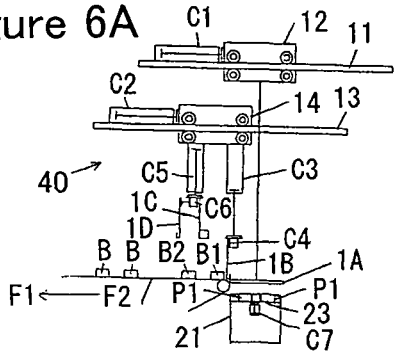
FIGS. 6A, 6B and 6C are explanatory views showing an operation of the tofu packing apparatus.
Figure 6B:
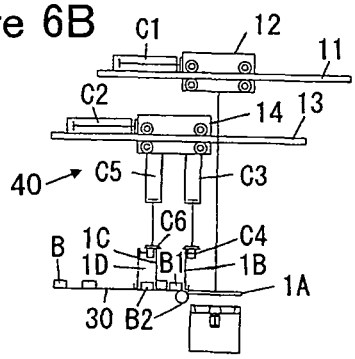
Figure 6C:
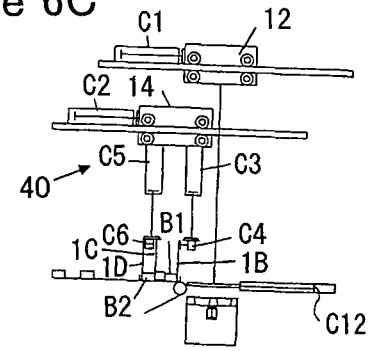

The grasp drive mechanism 40 is disposed above the conveyor belt 30 and is a reciprocation-drive mechanism, with its longitudinal direction directed to the width directions F3 and F4. As shown in FIGS. 6A-6C, the mechanism 40 grasps tofu group B on the conveyor belt 30 and move them above pack package group P, and open a pair of plate members 1B, 1D, to do cycle operation back to their original position to move upward. That is, to repeat the cycle operation of rectangular and round-trip, operation in the vertical direction in the downstream direction F1 or upstream direction F2 of the conveyor belt 30. The plate members 1B, 1D and 1C are driven, with horizontal motion cylinders C1 and C2, up-and-down motion cylinders C3 and C5 and small-stroke vice-horizontal motion cylinders C4 and C6 as drive sources. The drive sources such as the cylinders of the present invention are linear actuators including air cylinders and electromotive cylinders, for example, and are not particularly limitative insofar as the drive sources performs linear reciprocation drive and enables positioning. In addition, crank-type motors using a linear actuator, motors provided with an angle control function including a rotary encoder, with various kinds of decelerators or with inverter control, servo motors of direct coupled type, a motor power transmission system using a belt or chain and a linear drive mechanism utilizing a rotary actuator are raised. However, these are not limitative.

The horizontal motion cylinder C1 is attached to an unshown fixing member installed on the conveyor belt 30 and fulfills its function, with the fixing member as a foothold. Paired right and left track rails 11 are disposed on the conveyor belt 30 in parallel to the conveyor belt 30. A trolley vehicle 12 equipped with two pairs of rolling drive wheels R for vertically nipping the track rails 11 relative to paired right and left side panels, respectively, is incorporated into the track rails 11. The horizontal motion cylinder C1 is disposed toward the traveling direction of the conveyor belt 30 and has its rod end connected to the trolley vehicle 12. The trolley vehicle 12 such horizontal motion member is moving horizontal direction. That is to say, the trolley vehicle 12 reciprocation-moves in the upstream direction F1 or downstream direction F2 of the conveyor belt 30 within a range of a stroke of the horizontal motion cylinder C1.

The shutter plate 1A is connected to the trolley vehicle 12 via paired hanging arms 12A and positioned at substantially the same horizontal position as the conveyor belt 30 or slightly lower position. The shutter plate 1A moves together with the trolley vehicle 12 via the hanging arms 12A to reciprocate, i.e. cover the packaging packs P supplied to the downstream side of the grasp drive mechanism 40, move so as to contact the downstream side of the conveyor 10, and retract at a predetermined timing so that the packaging packs P may emerge. Incidentally, as the mechanism for allowing the shutter plate 1A to retract, a mechanism having the horizontal motion cylinder C1 connected to the shutter plate 1A and attaining reciprocation may be adopted (refer to FIG. 6C).

Below the trolley vehicle 12, another trolley vehicle 14 having the same constitution as the trolley vehicle 12 is disposed in parallel to the trolley vehicle 12 via a pair of track rails 13. The trolley vehicle 14 constitutes a drive portion of the grasp drive mechanism 40 and is disposed so as to travel in parallel to the trolley vehicle 12 driven with the horizontal motion cylinder C1 and be driven with the horizontal motion cylinder C2. The grasp drive mechanism 40 is provided with the pair of grasp plates 1B and 1D and spacer plate 1C that are connected to the lower trolley vehicle 14 and horizontally driven with the horizontal motion cylinder C2.

The three plates 1B, 1C and 1D of the grasp drive mechanism 40 are not directly connected to the trolley vehicle 14 and, of the pair of grasp plates 1B and 1D, the grasp plate 1B located in the downstream direction F2 is attached to hang from the trolley vehicle 14 via the vertical motion cylinder C3 and small-stroke vice-horizontal motion cylinder C4. Plural guide rods 14L for the vertical motion cylinder C3 having guide sleeves fixed to the trolley vehicle 14 are disposed upright between the trolley vehicle 14 and the grasp plate 1B. The vice-horizontal motion cylinder C4 has an attached posture, with an operation rod directed in the upstream direction F1.

On the other hand, the other grasp plate 1D is attached to hang from the trolley vehicle 14 via the vertical motion cylinder C5 and vice-horizontal motion cylinder C6 constituting the grasp drive mechanism 40. In addition, the spacer plate 1C is attached directly to the vertical cylinder C5 to droop between the pair of grasp plates 1B and 1D, is preferable. The three plates 1B, 1C and 1D have an upright posture and are located in parallel to each other, and this relationship is maintained even when the horizontal motion cylinder C1 and C2 or vertical motion cylinders C3 and C5 are operated. The vice-horizontal motion cylinder C6 has an attached posture with the operation rod directed in the upstream direction F1. Positional relationship of 1B, 1C, 1D group three plates are to increase grasp power for tofu group B, for example, the plates 1B, 1C and 1D are tilted a little to narrow down the surface in contact with the tofu group B, and/or, the plates 1B, 1C and 1D are set emboss to a level that does not damage the surface in contact with tofu group B.

Figure 3:
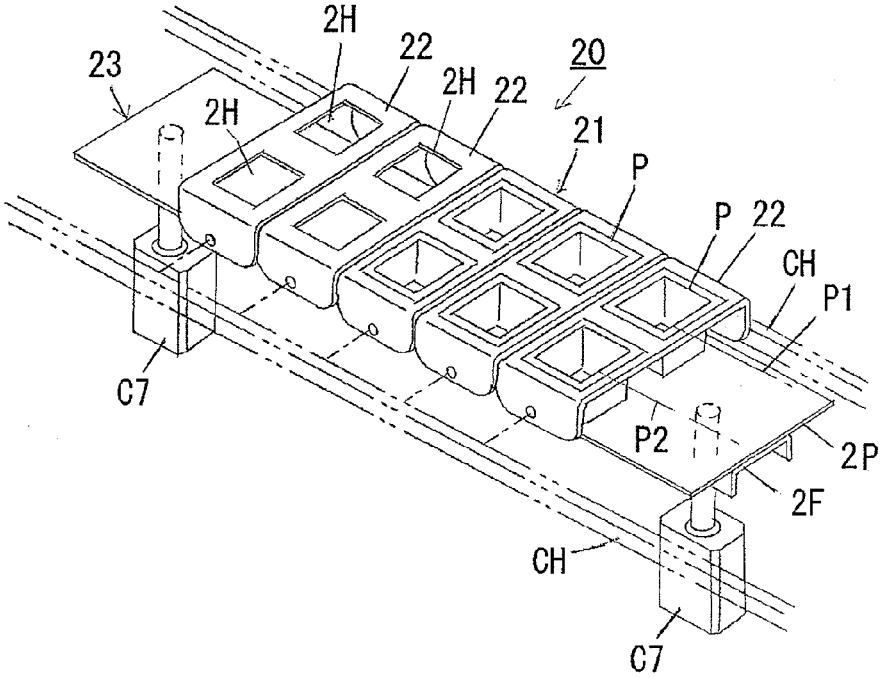
FIG. 3 is a perspective view showing a packaging pack conveyance apparatus constituting the tofu packing apparatus.

The conveyor 20 comprises a pack conveyor 21 and a knocking-up mechanism 23 (FIG. 3). The pack conveyor 21 is a kind of top plate-type chain conveyor having attached thereto plural top plates 22 for retaining, between two chains CH circulation-driven at a predetermined interval, the packaging packs P for the tofu blocks that are workpieces. The top plates 22 of the pack conveyor 21 are constituted such that independent plural metal plates are arranged in a caterpillar fashion in order to secure the flexibility of the chains CH and, in each top plate 22, a pair of right and left flanges connectable to link plates of the chains CH utilizing pin members are bending processed. Paired positioning holes 2H for dropping and positioning the packaging packs P are formed in each top plate 22 and arranged in the width direction of the pack conveyor 21. The positioning holes 2H formed in the top plates 22 have, as a whole, a predetermined arrangement in 2 columns in the traveling direction of the pack conveyor 21 and 13 rows in the width direction thereof.

The packaging pack P is an ordinary plastic tofu pack of a rectangular design provided on the periphery thereof with edges (flange portions) serving as paste allowances for welding lid seals thereto. The dimensional relationship between the packaging pack P and the positioning hole 22 of the top plate 22 is set such that when the packaging pack P is dropped from the bottom surface thereof onto the positioning hole 2H the edge portions of the packaging pack P remain on the top plate 22. The plenty of packaging packs P mounted on the pack conveyor 21 comprise packaging packs P1 and P2 arranged in 2 columns longitudinally and in 13 rows laterally.

The knocking-up mechanism 23 is set within a frame of the pack conveyor 21 and comprises an elevating plate 2P having a reinforcing channel 2F formed in the back surface thereof to secure the bending strength and one or more pusher cylinders C7 with the operation rods on the rear surface side of the elevating plate 2P directed upward (FIG. 3). The width of the elevating plate 2P can simultaneously cover the bottoms of the two packaging packs P and a width enabling vertical direction without interfacing with the right and left fringes of the top plate 22. The length of the elevating plate 2P is set to correspond to the width of the conveyor belt 30 (i.e. in the line direction of the tofu blocks B to be grasped, with the width of the knocking-up mechanism 23 directed to the column direction of the tofu blocks). Incidentally, the elevating plate 2P is an example of the knocking-up mechanism 23 and is not limitative insofar as it can knock up the bottom of the packaging pack P, with the bottom of the packaging pack P held horizontally.

Figure 4:
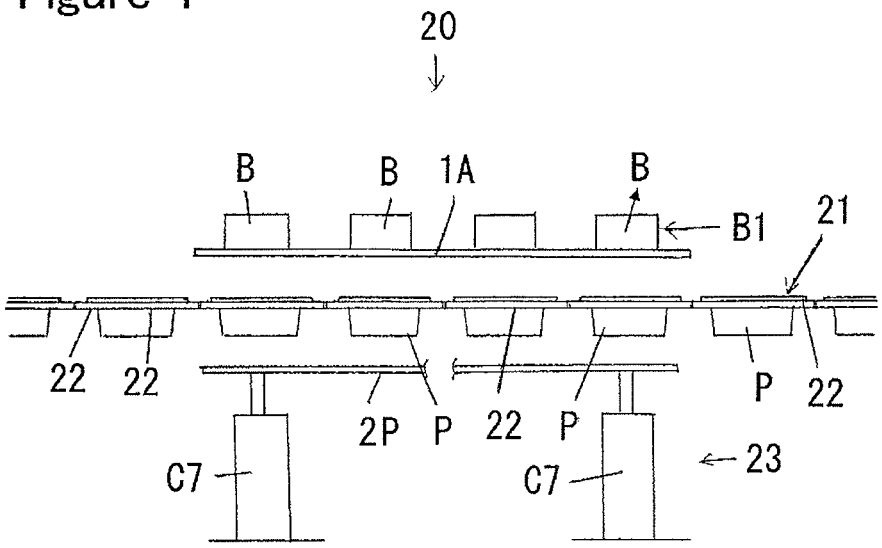
FIG. 4 is an explanatory view showing an operation of the packaging pack conveyance apparatus.
Figure 5:
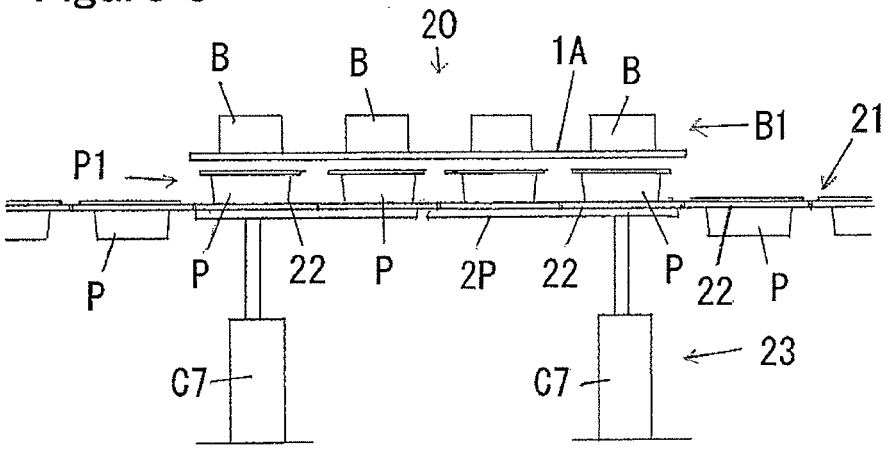
FIG. 5 is an explanatory view showing another operation of the packaging pack conveyance apparatus.

The knocking-up mechanism 23 can lift, within the range of the length of the elevation plate, 2 columns and 13 rows (N columns and M rows) of packaging packs P1 and P2 mounted on the pack conveyor 21 without lifting the top plates 22 through knocking up the elevation plate with the pusher cylinders C7 within the pack conveyor 21 (FIG. 4 and FIG. 5). When ignoring the thickness of the top plates 22, this operation enables each packaging pack P to be lifted around by the height of the pack. Since the weight exerted on the knocking-up mechanism 23 corresponds only to the weight of the packaging packs P, it can be ignored. In addition, when some water is poured into the packaging packs P, this is close enough. In the present invention, though an example of lifting the top plates 22 may be adopted, it is particularly preferred that the example of knocking up the packaging packs only reduces load exerted on the chains CH, pack conveyor 21 and packaging pack conveyance apparatus 20.

The control method in operating the packing apparatus of the tofu blocks B constituted of conveyor 10, packaging pack conveyance apparatus 20 and grasp drive mechanism 40, in which the operation order and operation timing of each functioning member, for example, can variously be set, is fundamentally as follows. As regards the horizontal operation of the grasp plates 1B and 1D and spacer plate 1C, it is noted that the whole plates are operated to move in parallel within the same phase with the track rails 11 and horizontal motion cylinder C1 (directly moving guide). In addition, in the present apparatus, though plenty of air cylinders are used as a power source for each functioning member, in the following description, as regards all the cylinders, the operation directed to housing the operation rod in the cylinder is expressed simply as the "−operation", and the operation directed to pushing out the operation rod having been housed in the housing is expressed simply as the "+operation".

The tofu blocks B cut to the predetermined size on the conveyor belt 30 are successively conveyed as tofu blocks B1 and B2 in an array state retaining given row and column intervals in alignment with a predetermined number of packaging packs P1 and P2 arranged in the width directions F3 and F4 (and the traveling directions F1 and F2) (FIG. 1 and FIG. 6A). The grasp drive mechanism 40 stands by until the first tofu blocks B1 reach the terminal end portion of the conveyor belt 30.

Figure 7A:
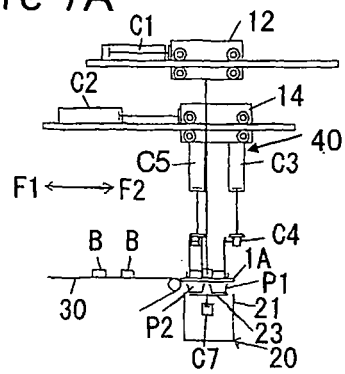
FIGS. 7A, 7B and 7C are explanatory views showing another operation of the tofu packing apparatus.

The standing-by state of the grasp drive mechanism 40 is as follows. The horizontal motion cylinder C1 undergoes the −operation, and the trolley vehicle 12 connected to the horizontal motion cylinder C1 travels in the upstream direction F1 while being guided with the track rails 11. The shutter plate 1A supported as hanging from the trolley vehicle 12 moves in the upstream direction F1 to be alongside the terminal end portion of the conveyor belt 30 (FIG. 6A). The pack conveyor 21 is located at a position immediately below the shutter plate 1A and causes the packaging packs P1 and P2 to stand by. The packaging packs P1 and P2 are lifted close by the shutter plate 1A by the +operation of the vertical motion cylinder C7 of the knocking-up mechanism 23 to stand by (FIG. 7A). While a suitable amount of water is poured into each packaging pack P, each packaging pack P may be filled with water.

At this point, however, the horizontal motion cylinder C2 also undergoes the −operation to move the lower trolley vehicle 14 to the uppermost portion of the operation in the upstream direction F1 and also move the plates 1B, 1C and 1D attached to the trolley vehicle 14 via the two vertical motion cylinders C3 and C5 to the uppermost portion on the upstream side at the uppermost position. Of the pair of grasp plates 1B and 1D at the horizontal position, the grasp plate 1B in the downstream direction F2 preferably descends, as occasion demands, to the nearest position just in front of the shutter plate 1A, i.e. to the terminal end portion of the conveyor belt 30, through the +operation of the vertical motion cylinder C3 (FIG. 6A). On this occasion, the vice-horizontal motion cylinder C4 interposed between the vertical motion cylinder C3 and the grasp plate 1B maintains the −operation. In addition, the vertical motion cylinder C5 supporting the other grasp place 1D and spacer plate 1C undergoes the −operation to still support these in a state pulling up these (FIG. 6A). On this occasion, the vise-horizontal motion cylinder C6 interposed between the vertical motion cylinder C5 and the grasp plate 1D undergoes +operation to assume a state in which the grasp plate 1D is pushed out in the upstream direction F1. That is to say, the two vise-horizontal motion cylinders C4 and C6, with the operation rods directed in the upstream direction F1, stand by in a state in which the paired grasp plates 1B and 1D have been operation in the directions opposed to each other. Here, as described above, why the grasp plate 1B in the downstream direction F2 descends to stand by is to support from the downstream side the leading row of tofu blocks B conveyed with the conveyor belt 30 and prevent the leading one row of tofu blocks B1 from overrunning. When the conveyor runs at a low speed to have no anxiety of overrun, the grasp plate 1B need not descend beforehand and may be in synchronization with the other grasp plate 1D or spacer plate 1C. Incidentally, in the particular case where the tofu blocks B on the conveyor belt 30 exhibit slight position aberration due to slight back and forth motion or slight rotation, in order to absorb some disarray of the rows and columns of tofu blocks B, the grasp plate 1B, spacer plate 1C and grasp plate 1D may be allowed to descend in the order mentioned in conformity to the tofu blocks B1 and B2 being conveyed with the conveyor belt 30. This is also effective when the row intervals of the tofu blocks B are comparatively wider than the grasp intervals formed before grasp by the grasp plates 1B and 1D or spacer plate 1C. However, the prior descending motion of the grasp plate 1B and successively descending motion of the plates are not indispensable to the present invention, and the motions may be in synchronization with the grasp plate 1D or spacer plate 1C.

At the time an unshown sensor system detects that the tofu blocks B1 and B2 located in the lowermost position in the downstream direction F2 in conjunction with the operation of the conveyor belt 30 have reached the descending and standing-by grasp plate 1B, the conveyor belt 30 is temporarily stopped. Subsequently, the vertical motion cylinder C5 undergoes +operation to allow the spacer plate 1C and grasp plate 1D on the upstream side are allowed to simultaneously descend (FIG. 6B). At this time, the spacer plate 1C descends in the set row interval between the first row of tofu blocks B1 and the second row of tofu blocks B2, and the grasp plate 1D descends to the upstream side F1 of the second row of tofu blocks B2. The sensor system is not particularly limited insofar as it is a sensor or measurement means capable of recognizing the presence of the workpieces, such as a reflection-mode displacement sensor, transmission-type photoelectric sensor, fiber sensor, etc.

After complete descent of the spacer plate 1C and grasp plate 1D to the aforementioned position (FIG. 6C), the vice-horizontal motion cylinder C4 undergoes the +operation and, at the same time, the vice-horizontal motion cylinder C6 undergoes the −operation. The +operation of the vice-horizontal motion cylinder C4 causes the grasp plate 1B on the downstream side to move horizontally and the first column of tofu blocks B1 so as to be pushed back to the spacer plate 1C, and the −operation of the vice-horizontal motion cylinder C6 causes the second column of tofu blocks B2 to be pushed to the spacer plate 1C. That is to say, the two vise-horizontal motion cylinders C4 and C6 operate independently of the horizontal motion cylinder C2 causes the pair of grasp plates B1 and B2 to be synchronously interlocked and driven to be close to each other, thereby grasping the two rows and 13 columns of tofu blocks B1 and B2 all altogether simultaneously in a very short period of time. Here, the tofu blocks B1 and B2 have a square or rectangular parallelepiped shape and have their anteroposterior surfaces in the conveyance direction brought into surface contact with the plates 1B, 1C and 1D by one third or more of the area of the side surfaces of the tofu blocks and, furthermore, that this contact is via water film. The water film may be water (whey) exuding from tofu blocks or sprinkled water. In the present embodiment, the tofu blocks B1 and B2 are taken out of the water tank and conveyed. Furthermore, water is sprinkled and having some water adhering thereto, is possible.

Upon completion of the grasp of the two rows and 13 columns of tofu blocks, the horizontal motion cylinder C2 undergoes the +operation to allow the trolley vehicle 14 to run in the downstream direction F2. The pair of grasp plates 1B and 1D and spacer plate 1C horizontally move in the downstream direction F2 while maintaining the state grasping two rows of tofu blocks in association with the horizontal motion of trolley vehicle 14, are regulated by the stroke of the horizontal motion cylinder C2 and positioned on the shutter plate 1A (FIG. 7A). Incidentally, may be adopted a process comprising causing the vertical motion cylinder C5 to undergo −operation at the anteroposterior timing of the +operation of the horizontal motion cylinder C2, floating the tofu blocks B from the conveyance surface of the conveyor 10, and causing the vertical motion cylinder C5 to undergo +operation at the timing the tofu blocks have stopped at the upper position of the packaging packs (substantially terminal end position of the horizontal motion cylinder C2) to land the tofu blocks B on the shutter plate 1A. An example of causing the vertical motion cylinder C5 to further undergo +operation to cause the tofu blocks to come close to or insert the tofu blocks in the packaging packs is preferred in the sense of enhancing the packing precision. When considering the operation of the grasp drive mechanism 40 in respect of the tofu blocks B1 and B2, the tofu blocks B1 and B2 are grasped with the pair of grasp plates 1B and 1D and spacer plate 1C in the front-back direction, in a deformation suppressed state of the tofu blocks B1 and B2, and allowed to slide or undergo air movement by a distance from the conveyor belt 30 up to the shutter plate 1A. As a consequence, since it is possible to reduce to a great extent break, damage and position aberration resulting from the deformation of the tofu blocks B1 and B2 during the conveyance, particularly transfer from the conveyor belt 30 to the shutter plate 1A.

In the meantime, the knocking-up mechanism 23 of the packaging pack conveyance apparatus 20 causes a pusher cylinder C7 to undergo +operation to lift until immediately below the shutter plate 1A the two columns and 13 rows of packaging packs P1 and P2 positioned below the shutter plate 1A, thereby allowing the packs to stand by (FIG. 5 and FIG. 7A).

Figure 7B:
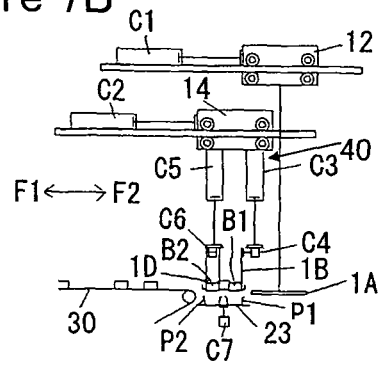
Figure 7C:
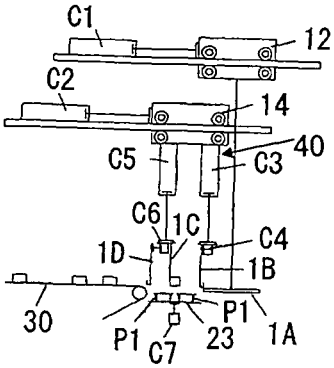

Subsequently, the horizontal motion cylinder C1 undergoes +operation to pull out in the downward direction F2 the shutter plate 1A having the two rows and 13 columns of tofu blocks B1 and B2 mounted thereon (FIG. 7B). At substantially the same timing as the retraction of the shutter plate 1A, the two vice-horizontal motion cylinder C4 and C6 undergo the −operation and +operation, respectively, and the paired grasp plates 1B and 1D open in the downstream direction F2 and upstream direction F1, respectively to release the grasped tofu blocks B1 and B2 (FIG. 2 and FIG. 7C). The two rows and 13 columns of tofu blocks B1 and B2 drop in the substantially horizontal state at the same time in the corresponding 13 rows and two columns of packaging packs P1 and P2 prepared below the shutter plate 1A. Here, "to house" indicates that after the retraction of the shutter plate 1A the tofu blocks B1 and B2 in the open state from the grasped state of the paired grasp plates 1B and 1D drop in the packaging packs and further that the grasped state is released or slightly loosened before the retraction of the shutter plate 1A and then the shutter plate 1A retracts to house the tofu blocks B in the packaging packs P through dropping. In addition, "to house" includes a case where the tofu blocks B1 and B2 are kept in the grasped state until being positioned above the packaging packs P1 and P2 even in the absence of the shutter plate 1A and then the grasped state released or slightly loosened to drop the tofu blocks in the packaging packs by their own weight.

Figure 8A:
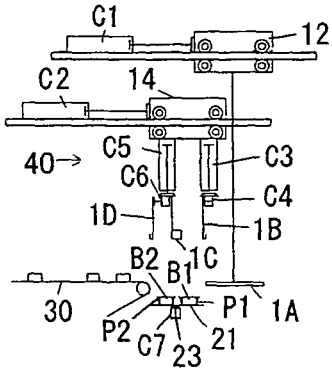
FIGS. 8A, 8B and 8C are explanatory views showing still another operation of the tofu packing apparatus.

Immediately before, simultaneously with or immediately after the packaging packs receive the tofu blocks B1 and B2, the knocking-up mechanism causes the pusher cylinder to undergo −operation and the floating packaging packs P1 and P2 to return to the original position of the pack conveyor 21 (FIG. 8A). The paired grasp plates 1B and 1D and spacer plate 1C having completed the motion of housing the tofu blocks B1 and B2 ascend at the same time through the −operation of the two vertical motion cylinders C3 and C4 and come into a housekeeping operation for returning again to the stand-by state (FIG. 6A). The descending motion of the knocking-up mechanism 23 is synchronously made simultaneously with or immediately after or before the start of retraction of the shutter plate 1A, and the tofu blocks B dropping during the descent of the packaging packs P are received in the packaging packs. Acceleration and deceleration of the descending motion are properly adjusted to lessen the impact in housing the dropping tofu blocks B in the packaging packs P as trapping a soccer ball and it is possible to infallibly prevent tofu breakage. This is preferable.

Figure 8B:
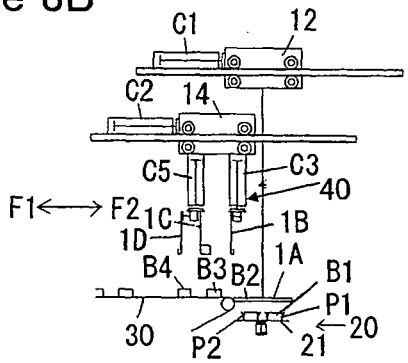

A concrete returning operation includes that the shutter plate 1A having retracted in the downstream side is brought alongside at the terminal end portion of the conveyor belt 30 through the −operation of the horizontal motion cylinder C1 and that the paired grasp plates 1B and 1D and spacer plate 1C turn back in the upstream direction F1 through the −operation of the horizontal motion cylinder C2 (FIG. 8B). In the meantime, the conveyor belt 30 moves third and fourth rows of tofu blocks B3 and B4 in the downstream direction F2, and the pack conveyor 21 of the packaging pack conveyance apparatus 20 takes out the packaging packs P1 and P2 having the tofu blocks B1 and B2 housed therein and successively supplies the empty packaging packs P1 and P2 to a position forward of the conveyor belt 30.

Figure 8C:
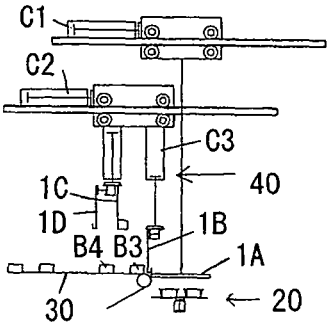

Subsequently, the grasp drive mechanism 40 lowers the grasp plate 1B on the downstream side to a position immediately before the shutter plate 1A through the +operation of the vertical motion cylinder C3 to await arrival of the third tofu blocks B3 (FIG. 8C). As a result, the return operation to the stand-by state is completed (refer to FIG. 6A).

Second Embodiment

Figure 9:
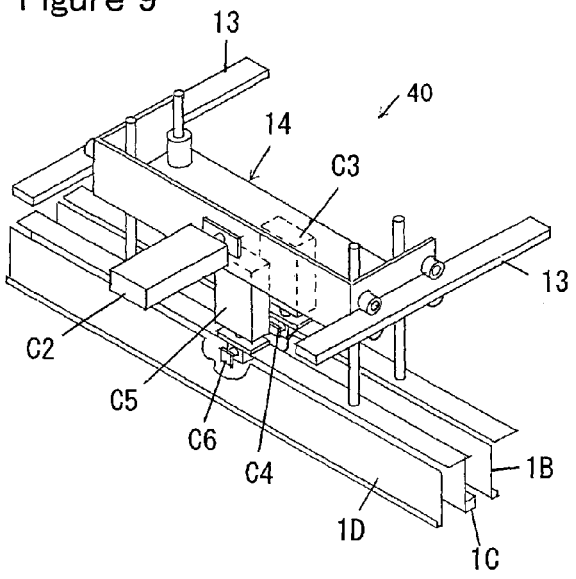
FIG. 9 is a perspective view showing another embodiment of tofu blocks in the present invention.
Figure 10:
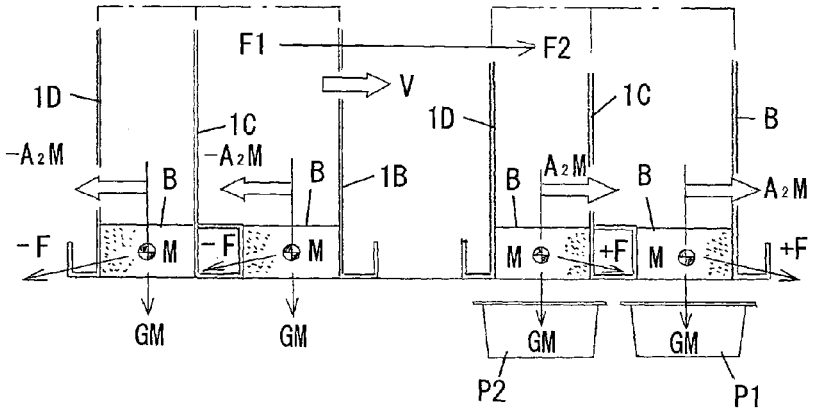
FIG. 10 is an explanatory view showing yet another operation of the tofu packing apparatus according to the second embodiment of the present invention.

The second embodiment of the present invention relates to an apparatus for performing the housing operation of the tofu blocks at a high speed without using the shutter plate 1A under the drive conditions of the plates 1B, 1C and 1D (FIG. 9 and FIG. 10).

In comparison with the grasp drive mechanism (FIG. 1) equipped with the shutter plate 1A, a grasp drive mechanism having no shutter plate 1A can have a simple structure having eliminated the shutter plate 1A, horizontal motion cylinder C1 for driving the shutter plate 1A and all members driven with the horizontal motion cylinder.

In the present embodiment having no shutter plate 1A, the paired grasp plates 1B and 1D and spacer plate 1C having grasped the tofu blocks B1 and B2 loosely are driven horizontally at a high acceleration or high deceleration speed to position the tofu blocks at the predetermined position on the corresponding packaging packs P1 and P2 affording not enough time to drop to the tofu blocks B1 and B2. Here, at the time the paired grasp plates 1B and 1D and spacer plate 1C of the grasp drive mechanism 40 have stopped, the tofu blocks B1 and B2 are allowed to drop in the packaging packs P1 and P2 through release of the grasped state. Otherwise, the grasped tofu blocks are allowed to slide and drop in the packaging packs P1 and P2 by their own weight, but at this time, the paired vice-horizontal cylinders C4 and C6 may be operated to loosen the grasped state and open the grasp plates 1B and 1D simultaneously with the stop of the paired grasp plates 1B and 1D and spacer plate 1C (FIG. 9). In the grasp drive mechanism, it may be adopted that the paired grasp plates 1B and 1D and spacer plate 1C in the state in which the tofu blocks B1 and B2 are strongly grasped are horizontally moved in a speed pattern including high acceleration speed, high deceleration speed and constant speed drive (with no acceleration) to position the tofu blocks B1 and B2 at the predetermined positions on the corresponding packaging packs P1 and P2.

Though it depends on the kind of tofu or grasped state (grasping force or grasping distance) that the aforementioned operations can be conducted without use of the shutter plate 1A, this is sufficiently possible in the case of cotton tofu having proper hardness. The experiments conducted have revealed that the above is possible in the case of ordinary cotton tofu or silken tofu (break power: 0.5 to 0.9 $N/m^2$≈about 50 to 90 $gf/cm^2$). To be specific, it is necessary that the paired grasp plates 1B and 1D and spacer plate grasp the tofu block B in a state in which the tofu block is distorted by its own elasticity and, in a state in which a constant force is maintained within a so range as not to break the tofu block B, all the plates be synchronically or synchronously interlock-driven. By adjusting the grasping force of the tofu block B or bring the tofu block in a state grasped from the four directions, it is possible to grasp the tofu block in air without being dropped even in the absence of the shutter plate 1A and even when the tofu is slightly soft. Otherwise, the grasp drive mechanism has a braking function for suppressing a dropping speed in the case where the tofu B slides and drops from the grasp plates 1B and 1D in the grasped state with the grasping force weakened, i.e. in the case utilizing tofu's own weight and a guide function for guiding the tofu to the inside of the packaging pack. The grasp drive mechanism 40 is important because, when the paired grasp plates 1B and 1D and spacer plate 1C have not been synchronically or synchronously interlock-driven, the tofu blocks B are dropped, damaged, afford added mass to other plates and are added with added mass. In addition, the grasp drive mechanism 40 is provided, as occasion demands, with a mechanism capable of variably adjusting the grasping interval accurately and a mechanism capable of variably adjusting the grasping force accurately to preferably maintain the grasping force exerted on the tofu block B at a constant level or more (and a breaking force of the tofu or less) at all times. Thus, even in the absence of the shutter plate 1A, it is possible to house the tofu blocks B1 and B2 in the packaging packs P1 and P2 without applying excessive force to the tofu blocks through making the grasped state firm with the plates 1B, 1C and 1D or driving the grasp drive mechanism 40 at a highly accelerated speed.

According to the present embodiment, in the grasp drive mechanism 40, it is possible to prevent the tofu blocks B from dropping through making firm the state of grasp with the paired grasp plates 1B and 1D and spacer plate 1C. Even in a slightly loosely grasped state, by driving the plates at high acceleration speed and moving the same horizontally above the conveyor belt 30 of the conveyor 10 and in air, the tofu blocks B can momentarily be positioned at the predetermined position on the packaging pack conveyance apparatus 20 without being dropped midway. That is to say, by suitably suppressing the grasping force exerted on the tofu blocks and enduring the always exerted gravitational force with a total retaining force of the surface tension added with the inertial force acting on the tofu blocks B conveyed at the acceleration speed, the tofu blocks are moved as being retained in the grasped state without being dropped. When the movement has stopped, the inertial force weakens or pegs out, thereby failing to endure the acting gravitational force and forcing the tofu blocks B to drop as sliding on the grasp plates in the absence of the slide table supporting tofu blocks B from below. However, when a larger force to prevent the tofu blocks B from being dropped is applied from the grasp plates to the tofu blocks B, the tofu blocks B are not dropped. Moreover, the tofu blocks B assume the state grasped by uniform force with the pair of grasp plates 1B and 1D and spacer plate 1C and the state adsorbed by the water surface tension on the paired grasp plates. Furthermore, a large stationary inertia acts on the tofu blocks B through the paired grasp plates 1B and 1D and spacer plate 1C moved at high acceleration (high deceleration) speed in the horizontal direction. That is to say, when the paired grasp plates 1B and 1D and spacer plate 1C are driven (slid at high speed or high acceleration speed) all together with the grasp drive mechanism 40, the total value of the various forces acting between the tofu blocks B and the paired grasp plates 1B and 1D and between the spacer plate 1C and the tofu blocks B is caused to surpass the forces exerted to drop the tofu blocks B to convey the tofu blocks until the positions of the packaging packs P without dropping the tofu blocks B. In the tofu blocks stopped at the predetermined positioned, the grasping force is preferred to be so appropriately weak as to drop the tofu blocks B when the inertial force added with the grasping force has weakened or disappeared and to suppress as much as possible damage to the tofu by the strong grasping force. Incidentally, in the case of hard tofu, the step of conveyance in the firmly grasped state and the steps of dropping and housing through release of the grasped state are easy to perform.

Even if the tofu blocks B immediately drop spontaneously without receiving any drop-preventing force in the absence of the slide table for supporting the tofu blocks from below and if the positioning of the tofu blocks B on the packaging packs P is completed before escaping between the paired grasp plates, it is possible to drop the tofu blocks B in the packaging packs P. That is to say, horizontal movement of the paired grasp plates at a highly accelerated speed means that the tofu blocks B are conveyed to the positions of the packaging packs P without affording to the tofu blocks any time for dropping. These operations can be materialized through the paired grasp plates 1B and 1D each constituted by an acceleration and deceleration drive mechanism. Furthermore, it is preferred to stop the conveyor belt 30 of the conveyor 10, grasp the tofu blocks B with the paired grasp plates, drive the conveyor belt 30 and, at the same time, move the paired grasp plates (at a highly accelerated speed) because it is possible to reduce the frictional resistance between the conveyor belt 30 and the tofu bottom surfaces and the deformation and crack of tofu. The conveyor 10 conveys the tofu blocks B taken out of the water tank or has a function to sprinkle water on the tofu blocks B and, as a result, the paired grasp plates 1B and 1D of the grasp drive mechanism 40 can grasp the tofu blocks B having water adhering thereto and easily move the same by the predetermined distance. The adhering water serves as a water film assisting in grasping with the paired grasp plates 1B and 1D and in smoothing release of the grasped state. Incidentally, in order to prevent damage of the tofu blocks B, with the frictional force between the grasp plates and the surfaces of the tofu blocks B kept down, it is preferred that the paired grasp plates 1B and 1D grasp the tofu blocks B via the water film.

In the grasp drive mechanism, a large stationary or motive inertial force acts on the tofu blocks B in the horizontal direction from the start of conveyance to the stop at the predetermined position when the paired grasp plates 1B and 1D grasping the tofu blocks B have been operated at the predetermined accelerated (and decelerated) speed. Immediately after the inertial force by the accelerated or decelerated horizontal movement preventing dropping of the tofu blocks B weakens or disappears, the tofu blocks B slide down or drop by the gravitational force from between the paired grasp plates 1B and 1D in the packaging packs P prepared downward. In the case of the tofu blocks B having slid down, since the dropping speed can be suppressed through small adjustment of the grasping force, tofu's damage by dropping is suppressed and, in the case of the spontaneous dropping, since possible individual errors in dropping timing of the individual tofu blocks B can be eliminated, packing precision can be enhanced.

An explanation will be made under the above conditions with reference to FIG. 10. When the plates 1B, 1C and 1D have been driven in the downstream direction F2 at an acceleration speed $A_2$ and when mass M comprises the tofu blocks B1 and B2, a stationary inertial force of $-A_2M$ acts on each tofu block B in the upstream direction F1. In addition, the downward gravitational force GM always acts on each tofu block B. Therefore, the force exerted on the tofu block B when being conveyed in the downstream direction F2 is represented by a net force −F of the stationary inertial force $-A_2M$ and gravitational force GM. In addition, the net force −F makes a direction approaching a horizontal posture in the upstream direction F1 when the stationary inertial force $-A_2M$ relative to the gravitational force GM is as large as possible, i.e. when the acceleration speed $A_2$ of the plates 1B, 1C and 1D in the downstream direction is as large as possible.

By means of the net force −F having a component directed to the upstream direction, the surface pressure between the grasp plate 1D and the tofu block B and between the spacer plate 1C and the tofu block B being positioned in the upstream side relative to the tofu block B becomes high, whereas the surface pressure between the grasp plate 1B and the tofu block B and between the spacer plate 1C and the tofu block B being positioned on the downstream side relative to the tofu blocks B becomes low or zero. Here, even when the surface pressure between the tofu blocks B and a specific plate turns to be zero, it is important that the grasping force (clamping force) of the specific grasping plate surface relative to the downstream side surface of the tofu blocks B is not lost. There is also an adsorption force between each plate and the tofu blocks B owing to the surface tension of the water (whey) exuding from the tofu blocks B (this action has been known under the experimental rule, such as the adsorption phenomenon of tofu relative to a kitchen knife in cooking tofu. That is to say, insofar as the plates 1B, 1C and 1D are always driven at the acceleration speed (including deceleration speed) $A_2$ the tofu blocks B does not drop even in the absence of the shutter plate 1A (motion like "dice stacking").

A phenomenon similar to the above phenomenon occurs when stopping the plates 1B, 1C and 1D. When the plates 1B, 1C and 1D have been stopped, the motive inertial force $A_2M$ once acts on the tofu blocks B in the downstream direction, and a net force F of the gravitational force GM and the motive inertial force $A_2M$ is exerted on each tofu block B. For this reason, the surface pressure between the grasp plate 1B and the spacer plate 1C and the tofu blocks B positioned in the downstream side relative to the tofu blocks B become high, whereas the surface pressure between the grasp plate 1D and spacer plate 1C and the tofu block B positioned on the upstream side relative to the tofu blocks B becomes low or turns to be zero. However, the tofu blocks B do not drop for the same reason as described above (FIG. 10).

Immediately after the grasp drive mechanism 40 has position and stopped the plates 1B, 1C and 1D at the predetermined positions, the motive inertial force $A_2M$ disappears. As a result, only the gravitational force GM remains, and the tofu blocks B1 and B2 are slid down and dropped in the packaging packs P1 and P2 or dropped and housed therein through loosening the grasping state of the grasp plates or opening the grasp plates. In this housing operation of the tofu blocks B1 and B2, since there is neither the operation time nor the stand-by time of the shutter plate 1A and since the time for horizontally conveying the tofu blocks B1 and B2 is shortened, the packing process for the tofu blocks B can be shortened to a great extent and furthermore the processing capacity in the production line can be enhanced.

Here, in each of the above embodiments, the two rows of tofu blocks B1 and B2 are processed simultaneously. However, a constitution may be adopted in which the spacer plate 1C of the grasp drive mechanism 40 is omitted and the tofu blocks B are processed in a one-row unit. In addition, even when the spacer plate 1C is interposed between the paired grasp plates, an example of grasping the tofu blocks between one of the grasp plates and the spacer plate 1C is conceivable. Furthermore, it is possible to increase the number of spacer plate 1C and dispose plural sets of the paired grasp plates 1B and 1D so as to grasp plural rows (three or more rows) or plural columns (three or more columns) of the tofu blocks.

Third Embodiment

The third embodiment has plural sets of paired grasp plates 1B and 1D and, similarly to the first and second embodiments each having the spacer plate 1C, packs tofu blocks in plural packaging packs P1 and P2.

Figure 11A:
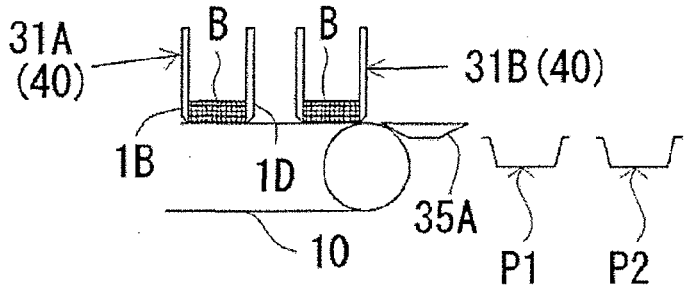
FIG. 11A to FIG. 11E are views showing a constitution of array and use example of a pair of grasp plates of the tofu packing apparatus according to the third embodiment of the present invention.
Figure 11B:
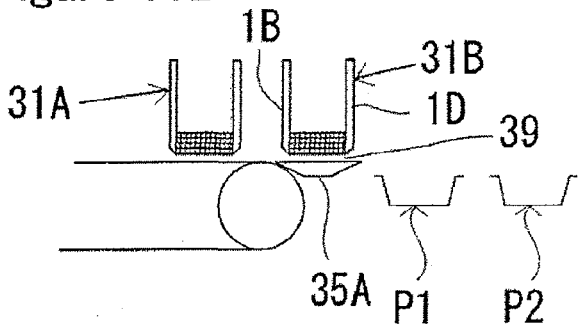
Figure 11C:
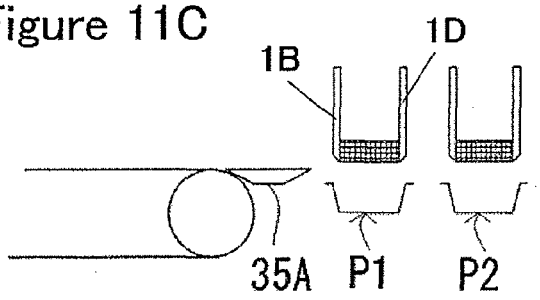

FIG. 11A to FIG. 11E are views showing the steps, in order, of the embodiment in which there are two sets 31A and 31B of the paired grasp plate 1B and 1D that are disposed in parallel or series in a width direction (row-unit directions F3-F4) or a traveling direction (column-unit directions F1-F2). A knife-edge type small-sized conveyor belt 35A having a knife-edge shape is disposed at the downstream end of the conveyor 10. The small-sized knife-edge conveyor belt 35A eliminates difference in level relative to the conveyor 10 and moves the tofu blocks so as to slide on the packs P1 and P2. Consequently, the tofu blocks B1 and B2 are conveyed from the conveyor belt 35A to the packaging packs P1 and P2 so as to float (denoted by reference numeral 39 in FIG. 11B is a gap formed during floating) and moved in the state grasped between the paired plates 1B and 1D, dropped and housed. Incidentally, instead of the conveyor belt 35A, a horizontal or longitudinally inclined chute plate may be disposed at the downstream end of the conveyor 10 and sliding means including an automatic rotary roller and a floating rotary roller may intervene. In this way, in the grasp drive mechanism 40 (31A and 31B) having grasped the tofu blocks B1 and B2, when the tofu blocks B1 and B2 are operated so as to slightly float upward and separate from the belt surface of the conveyor 10, drawbacks including friction between tofu blocks and the conveyor 10 or conveyor belt 35A and occurring at a relay portion between the conveyor and the conveyor belt can be reduced.

Figure 12A:
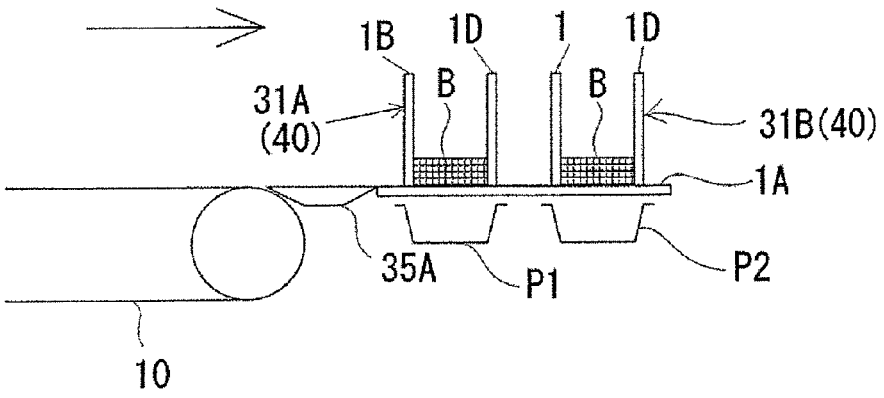
FIGS. 12A, 12B and 12C are views showing another constitution of array and use example of the pair of grasp plates of the present invention.
Figure 12B:
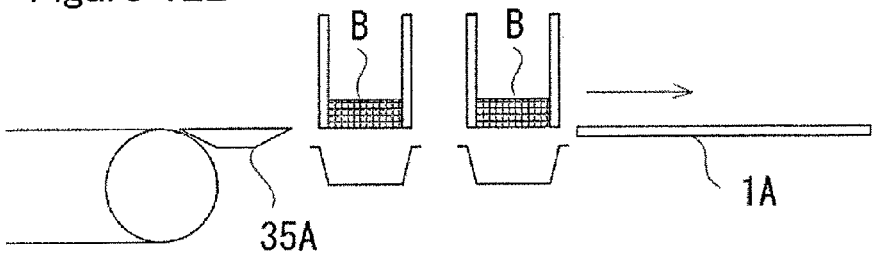
Figure 12C:
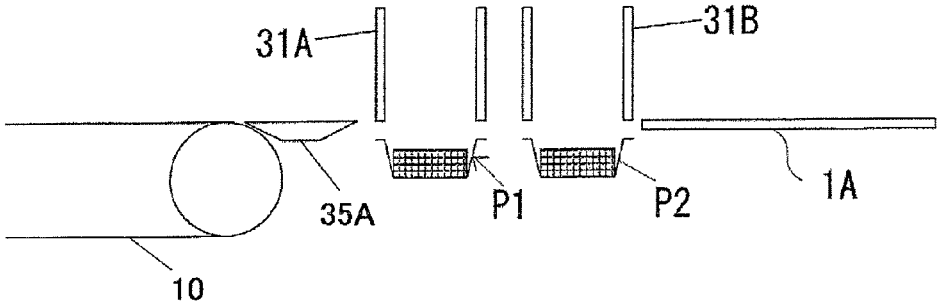

FIG. 12A to FIG. 12C are views showing the steps in order in the case of using the two sets 31A and 31B of pared grasp plates 1B and 1D, small-sized knife-edge conveyor belt 35A and shutter plate 1A moved to contact the conveyor belt 35A and caused to retract. The small-sized knife-edge conveyor belt 35A eliminates difference in level relative to the shutter plate 1A and moves the tofu blocks B1 and B2 grasped between the paired grasp plates 1B and 1D onto the shutter plate 1A so as to slide on the packs P1 and P2. Then, by causing the shutter plate 1A to retract, the tofu blocks B1 and B2 grasped with the two sets of paired grasp plates 31A and 31B are dropped and housed in the packs P1 and P2.

Figure 11D:
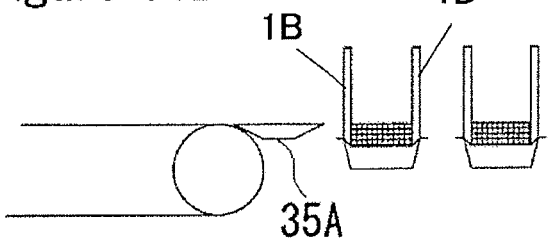
Figure 11E:
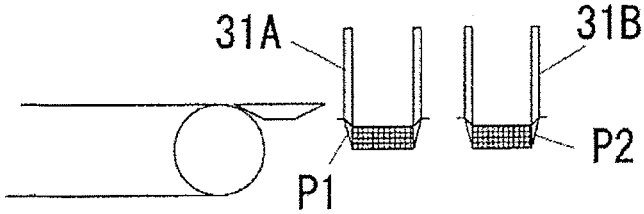
Figure 13A:
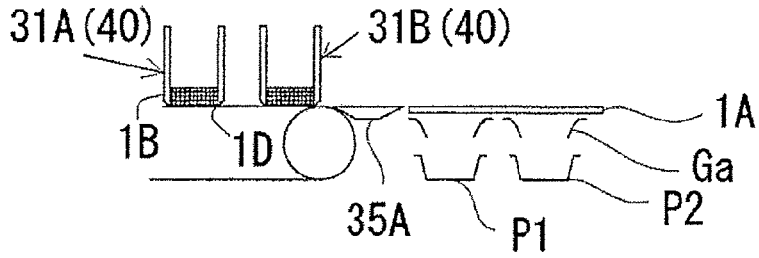
FIG. 13A to FIG. 13F are views showing still another constitution of array and use example of the pair of grasp plates of the present invention.
Figure 13B:
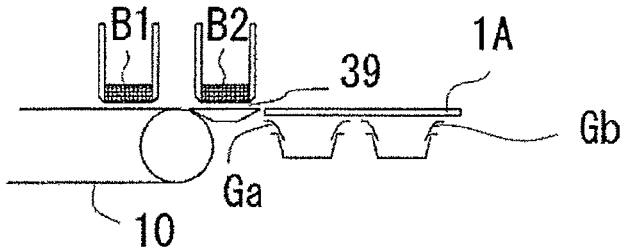
Figure 13C:
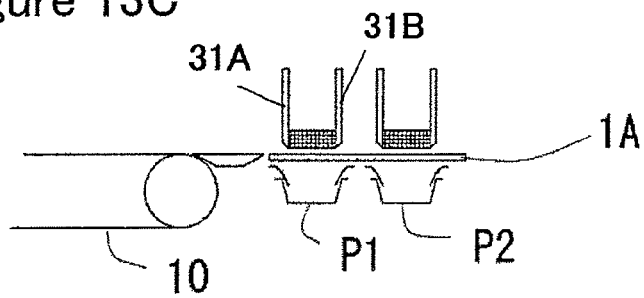
Figure 13D:
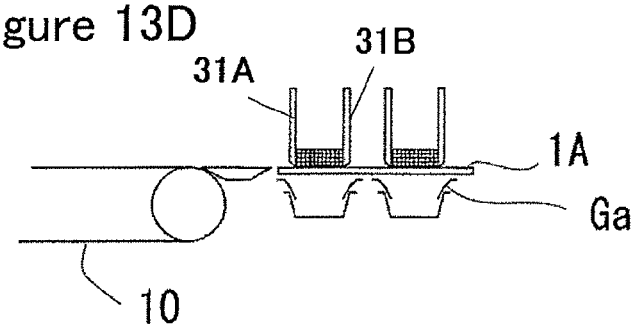
Figure 13E:
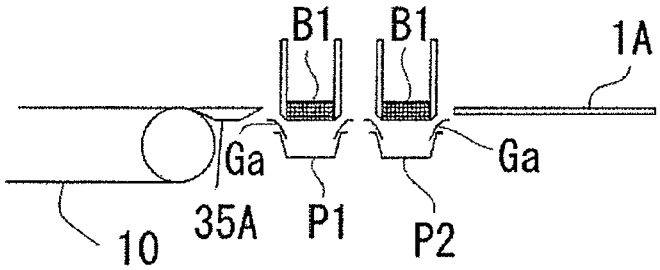
Figure 13F:
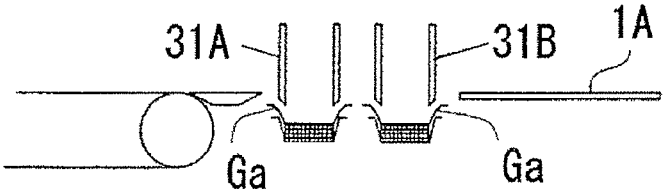
Figure 14A:
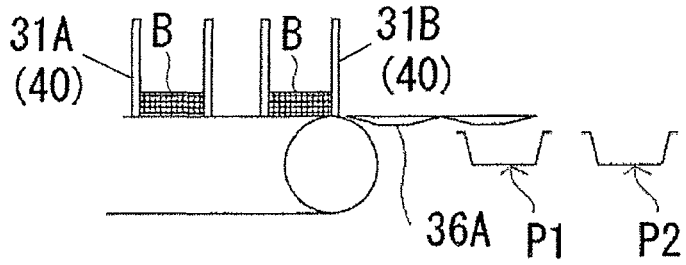
FIG. 14A to FIG. 14E are views showing yet another constitution of array and use example of the pair of grasp plates of the present invention.
Figure 14B:
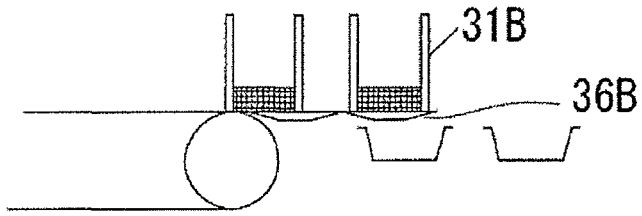
Figure 14C:
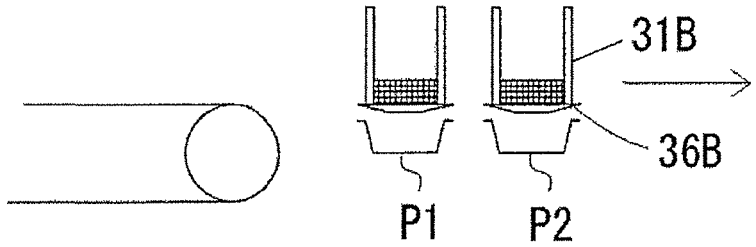
Figure 14D:
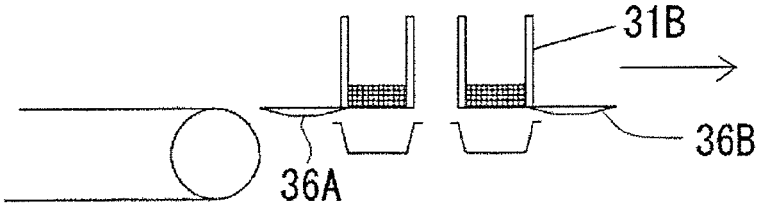
Figure 14E:
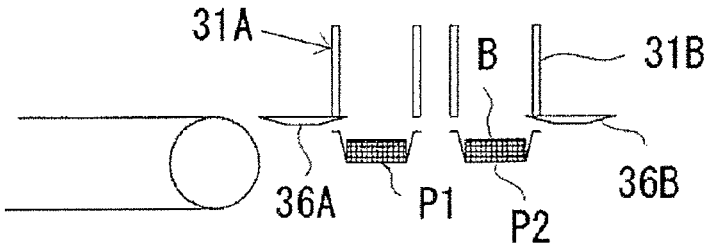

FIG. 13A to FIG. 13F are views showing the steps in order in the case of packing the tofu blocks in the packs via guides Ga. The guide Ga is provided for each of the packaging packs P1 and P2 and has its upper end flush with or slightly lower than the conveyance surface of the conveyor belt 35A or may be positioned on the back surface of the shutter plate 1A and fixed to a base. When the packaging packs P1 and P2 are caused to ascend with the knocking-up mechanism 23, the guides Ga approximate the openings of the packaging packs or may interpolate the packs. The tofu blocks are moved together with the opening and closing drive of the shutter plate 1A or may be positioned appropriately on the packaging packs P1 and P2 using a separate drive apparatus. Otherwise, the grasp plates 1B and 1D per se have a guide function as shown in FIG. 11D and FIG. 11E and descend and approximate the openings of the packaging packs or may interpolate the packs. Then, the tofu blocks B1 and B2 grasped between the paired grasp plates 1B and 1D are dropped above the packs P and packed in the packs along the guides Ga. The tofu blocks B are conveyed onto the packaging packs P1 and P2 so as to float from the conveyor belt 35A (denoted by reference numeral 39 in FIG. 13B is a gap formed during floating), thereby eliminating the difference in level relative to the guides Ga and packing the tofu blocks in the packs.

Figure 15A:
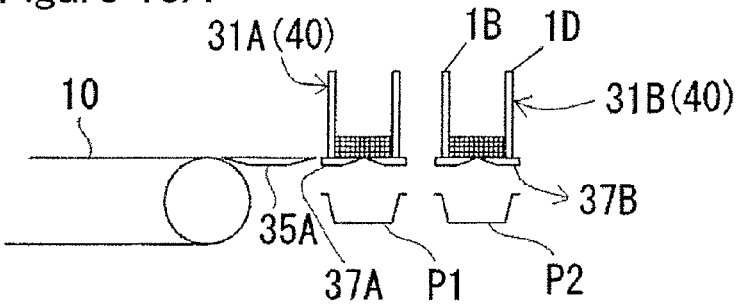
FIGS. 15A, 15B and 15C are views showing yet another constitution of array and use example of the pair of grasp plates of the present invention.
Figure 15B:
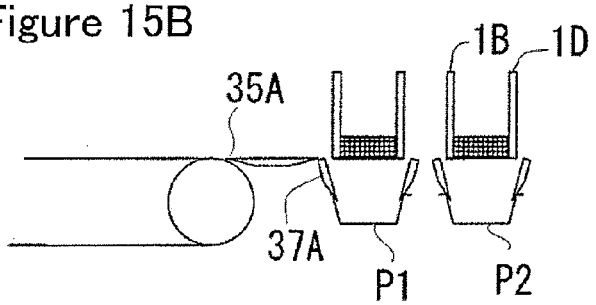
Figure 15C:
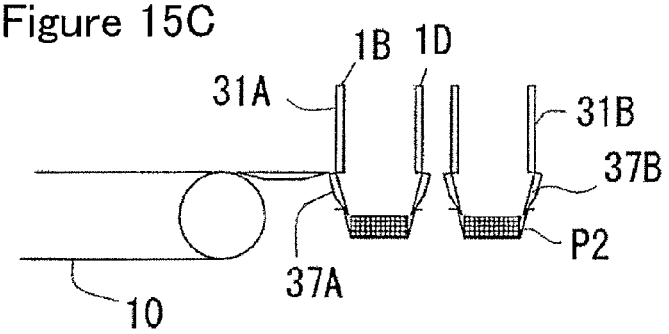

FIG. 14A to FIG. 14E are views showing the steps in order in the case of packing the tofu blocks in the two columns of packaging packs P1 and P2 using the small-sized knife-edge conveyor belt 35A and a driving shutter plate 36B. The two sets of shutter plates 36A and 36B mount thereon two sets of tofu blocks B1 and B2 and are opened to drop the tofu blocks and pack the same in the packs. That is to say the driving shutter plate 36B fulfills the same function as the aforementioned shutter plate 1A, approximates the small-sized conveyor belt 35A on the side of the conveyor 10, can retract in a direction opposed to the conveyor 10. However, the two sets of shutter plates 36A and 36B contact and separate from the fixed conveyor belt 35A. The driving shutter plate 36A comprises an ordinary mechanism that linearly reciprocates and causes the emergence and stoppage of the upper openings of the packaging packs P1 and P2 below the tofu blocks B1 and B2. In addition, the shutter plate may be an openable shutter plate comprising plural plates or, as shown in FIG. 15A to FIG. 15C, for example, a rotation drive openable shutter plate 37A (two or four plates used per packaging pack). Particularly, as shown in FIG. 15C, the opened shutter plate 37A can function as a guide or chute. The openable shutter plates 37A and 37B are synchronized with the grasp release of the paired grasp plates 1B and 1D to house the tofu blocks B1 and B2 in the packaging packs P1 and P2.

Figure 16:
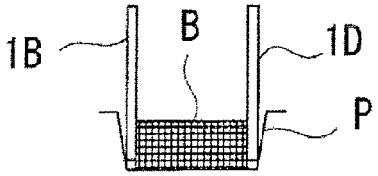
FIG. 16 is a view showing one example of tofu packed with the pair of grasp plates according to the present invention.
Figure 20:
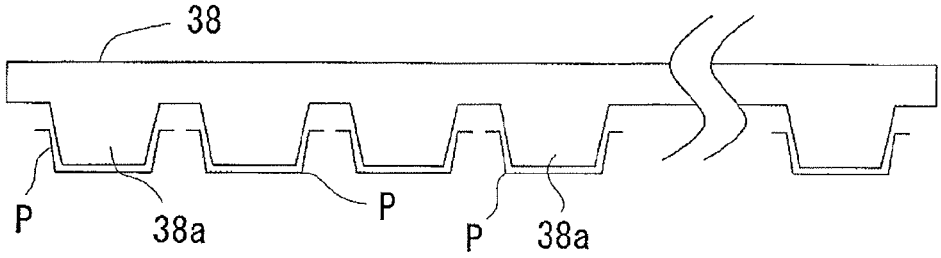
FIG. 20 is a side view showing an example in which each plate of the present invention descends from above a packaging pack and is inserted into an opening of the packaging pack.

In any of the above cases, when housing the tofu blocks B1 and B2 in the packaging packs P1 and P2, the tofu blocks B1 and B2 are dropped through the grasp release of the paired grasp plates 1B and 1D at the positions above the packaging packs P1 and P2, or the tofu blocks B1 and B2 are inserted together with the paired grasp plates 1B and 1D into the packaging packs P and dropped through the grasp release of the grasp plates 1B and 1D. Otherwise, the tofu blocks may be allowed to descend together with the paired grasp plates 1B and 1D to approximate the openings of the packaging packs P1 or P2 or are inserted into the interiors (or bottoms) of the packaging packs to house the tofu blocks B1 and B2 in the packs through the grasp release (FIG. 11E and FIG. 16). This is because damage of the tofu blocks B1 and B2 by dropping impact can be reduced. In this case, the grasp plates 1B and 1D having a narrower width section than the inside dimension of the packaging packs P are used. The spacer plate 1C is also used. In addition, a sheet of plate member having the lower end notch-processed in a convexo-concave manner may be used. It is preferred that the longitudinal grasp plates 1B and 1D and spacer plate 1C have the convexo-concave lower portions when seen from the side of each plate, descend from above the packaging packs to cause the convex portions to be inserted into the openings of the packaging packs even slightly, thereby causing the tofu blocks to be dropped and housed in the packaging packs (FIG. 20). In this case, it can be said that the grasp plates 1B and 1D and spacer plate 1C have a guide function like the guide Ga.

Figure 17A:
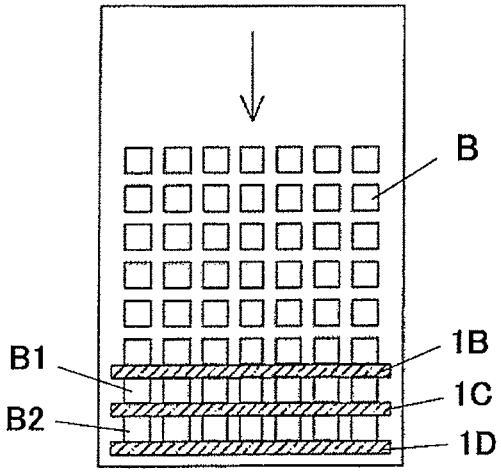
FIG. 17A to FIG. 17E are views showing a constitution of array and use example a pair of grasp plates of the present invention.
Figure 17B:
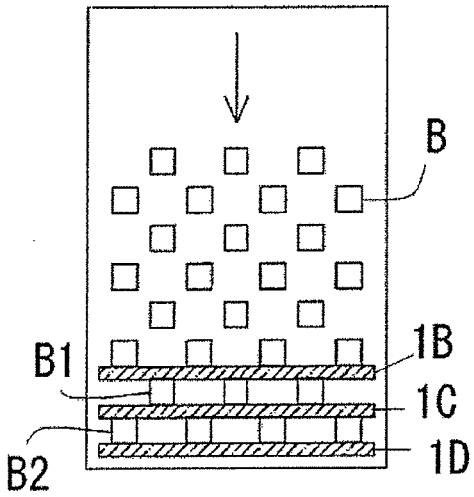
Figure 17C:
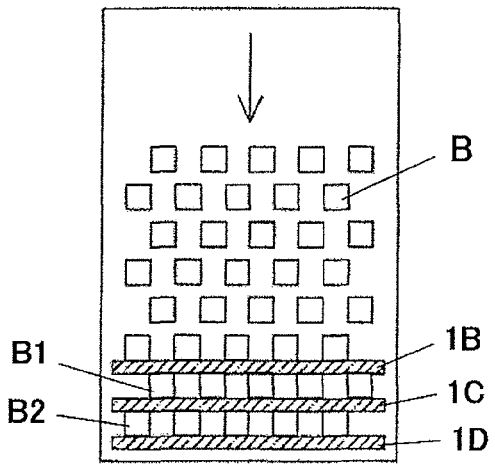
Figure 17D:
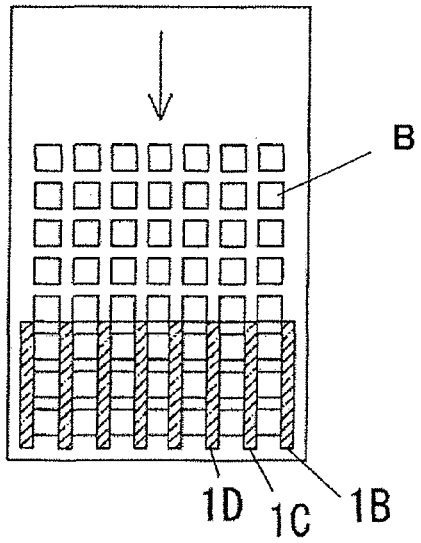
Figure 17E:
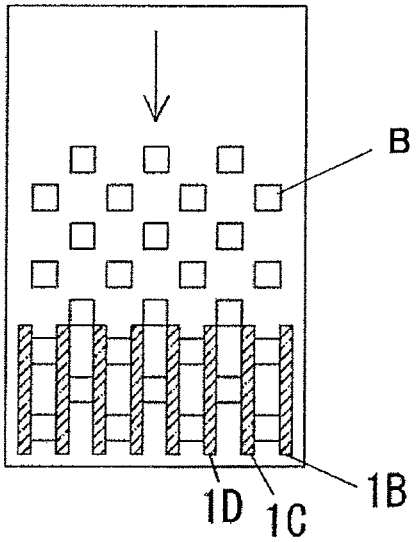
Figure 18A:
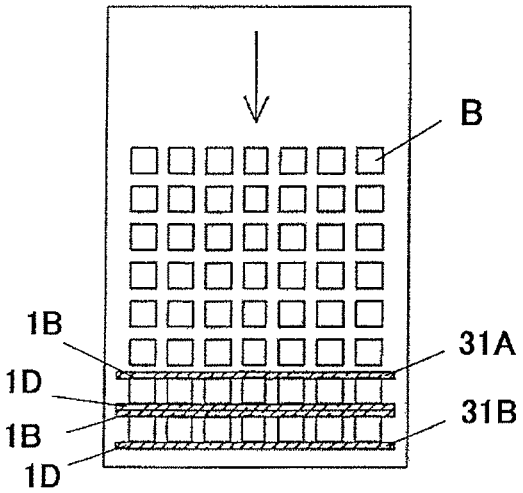
FIG. 18A to FIG. 18E are views showing another constitution of array and use example a pair of grasp plates of the present invention.
Figure 18B:
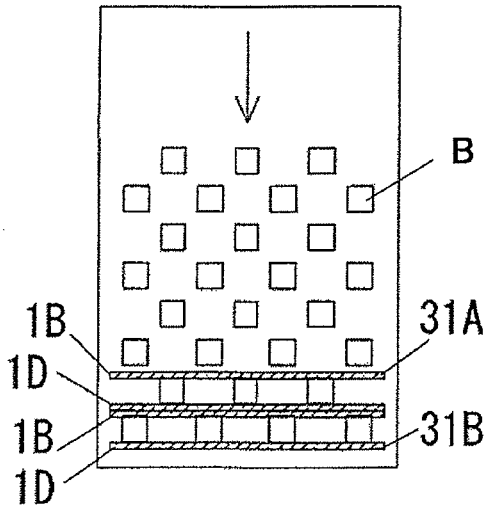
Figure 18C:
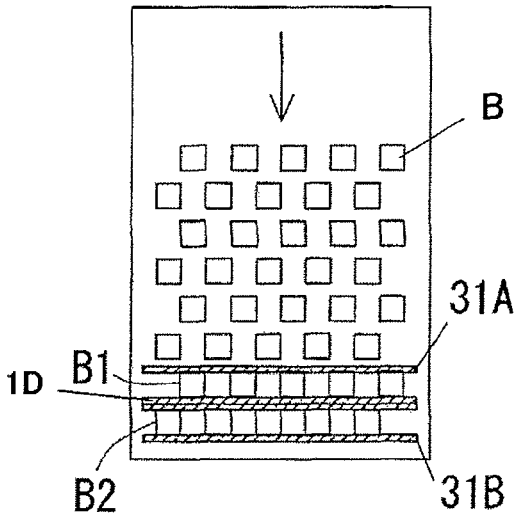
Figure 18D:
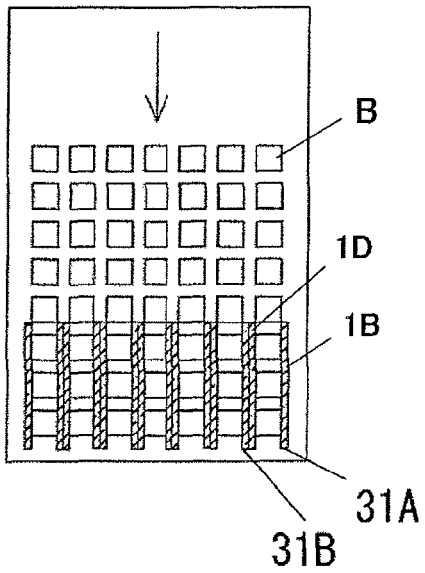
Figure 18E:
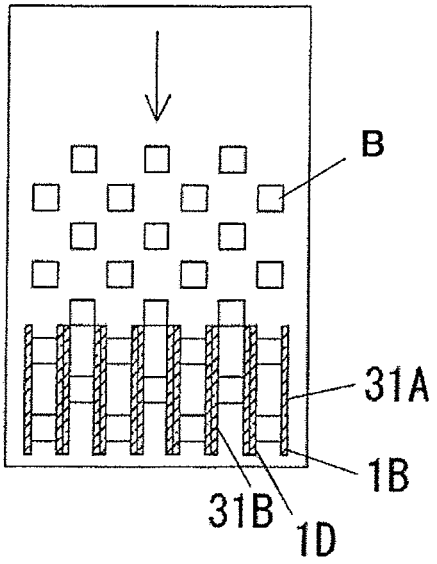

Next, how to pack will be described. The paired grasp plates 1B and 1D are disposed, with their longitudinal direction along the width directions (F3-F4 directions) of the conveyor 10. FIGS. 17D and 17E show the paired grasp plates disposed along the traveling directions (F1-F2 directions) of the conveyor 10. In either case, the tofu blocks B1 and B2 arranged in a zigzag form can be grasped as-is and packed. Incidentally, the spacer place 1C is interposed between the paired grasp plates 1B and 1D.

Here, another set of paired grasp plates 42A and 42B disposed in plural along the traveling directions (F1-F2 directions) of the conveyor 10 have the same constitution as the apparatus 1 of the first and second embodiments and are different in direction by 90° therefrom. Incidentally, the trolley vehicle 12 operated on the upward side secures the movement of the paired grasp plates.

FIG. 18A to FIG. 18E show the case of no spacer plate 1C between the paired grasp plates 1B and 1D and capable of grasping the tofu blocks B1 and B2 arranged in the zigzag form as-is and packing the same.

Figure 19A:
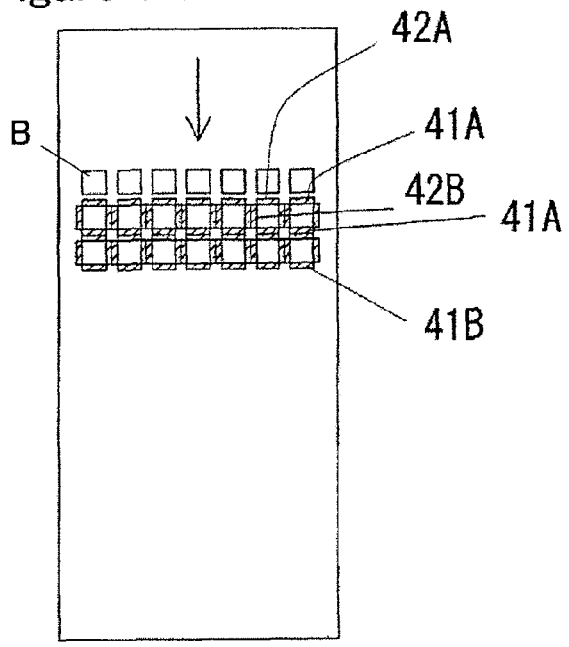
FIG. 19A and FIG. 19B are views showing still another constitution of array and use example a pair of grasp plates of the present invention.
Figure 19B:
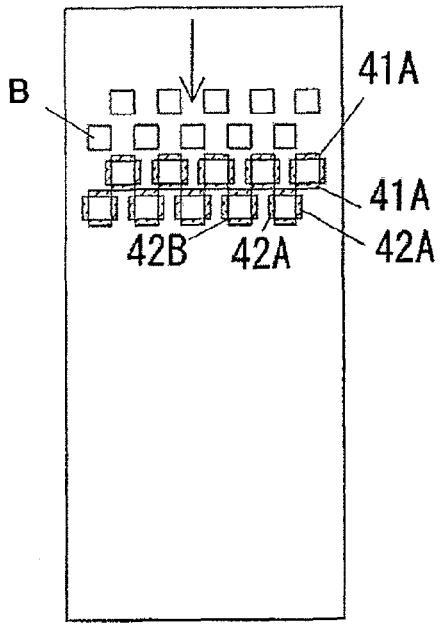

FIG. 19A and FIG. 19B are views showing the case where individual tofu blocks B are packed in packaging packs in form of selling, respectively, and the individual tofu blocks B are grasped from the four directions using two sets of paired grasp plates 41A and 41B. One set of paired grasp plates 41A and 41B are disposed in plural along the width directions (F3-F4 directions) of the conveyor 10. The other set of paired grasp plates 42A and 42B are disposed in plural along the traveling directions (F1-F2 directions) of the conveyor 10. For this reason, the individual tofu block B is grasped as being surrounded from the four directions.

The invention claimed is:

1. A tofu packing apparatus for packing plural tofu blocks in individual packs, comprising:

a pair of grasp plates driven in a direction to approach each other, for grasping the tofu blocks;

a horizontal drive device connected to the pair of grasp plates, and driving the pair of grasp plates in a horizontal direction for conveying the tofu blocks above packaging packs;

a vertical drive device connected to the pair of grasp plates, and driving the pair of grasp plates in a vertical direction of the pair of grasp plates; and a vice-horizontal motion cylinder arranged between the vertical drive device and the pair of grasp plates, to open and close the pair of grasp plates;

wherein the pair of grasp plates is arranged to grasp the tofu blocks cut to a predetermined size to move the tofu blocks to predetermined positions above the packaging packs, and to release the tofu blocks and pack the tofu blocks in the packaging packs, or, to maintain grasping of the tofu blocks so that weights of the tofu blocks cause the tofu blocks to drop from the pair of grasp plates due to gravity and pack the tofu blocks in the packaging packs, the horizontal drive device includes a horizontal motion cylinder moving the pair of grasp plates in the horizontal direction for conveying the tofu blocks above the packaging packs, and the vertical drive device includes a vertical motion cylinder moving the pair of grasp plates in the vertical direction.

2. A tofu packing apparatus according to claim 1, further comprising:

a conveyor for conveying a plurality of tofu blocks cut to the predetermined size and arrayed at predetermined intervals, and a packaging pack conveyance apparatus disposed at a downstream end of the conveyor, for conveying the packaging packs, wherein the conveyor is arranged to convey the plurality of tofu blocks in an array of M rows, N columns, or M rows and N columns, wherein the packaging pack conveyance apparatus conveys the packaging packs, in a direction orthogonal to a direction of conveying the tofu blocks, to predetermined positions in an array of N rows, M columns, or N rows and M columns, and wherein the tofu blocks are grasped with the pair of grasp plates in a width direction of the conveyor or a conveyance direction of the conveyor in the array of M rows, N columns, or M rows and N columns in conformity with the array of the packaging packs and conveyed to the predetermined positions above the packaging packs.

3. A tofu packing apparatus according to claim 2, further comprising a plurality of another pair of grasp plates to grasp the tofu blocks in a unit of M rows or in a unit of N columns.

4. A tofu packing apparatus according to claim 2, wherein the pair of grasp plates includes at least one spacer plate therebetween, and the pair of grasp plates with the spacer plate grasps the plural tofu blocks arranged in the M rows and N columns.

5. A tofu packing apparatus for packing plural tofu blocks in individual packs, comprising:

a pair of grasp plates driven in a direction to approach each other, for grasping the tofu blocks;

a horizontal drive device connected to the pair of grasp plates, and driving the pair of grasp plates in a horizontal direction for conveying the tofu blocks above packaging packs; and a vertical drive device connected to the pair of grasp plates, and driving the pair of grasp plates in a vertical direction of the pair of grasp plates, wherein the pair of grasp plates is arranged to grasp the tofu blocks cut to a predetermined size to move the tofu blocks to predetermined positions above the packaging packs, and to release the tofu blocks and pack the tofu blocks in the packaging packs, or, to maintain grasping of the tofu blocks so that weights of the tofu blocks cause the tofu blocks to drop from the pair of grasp plates due to gravity and pack the tofu blocks in the packaging packs, the vertical drive device is arranged so that a spacer plate disposed between the pair of grasp plates moves downward simultaneously with one of the grasp plates of the pair of grasp plates, and a vice-horizontal motion cylinder is arranged so that the spacer plate moves in the horizontal direction simultaneously with said one of the grasp plates of the pair of grasp plates.

6. A tofu packing apparatus for packing plural tofu blocks in individual packs, comprising:

a pair of grasp plates driven in a direction to approach each other, for grasping the tofu blocks;

a horizontal drive device connected to the pair of grasp plates, and driving the pair of grasp plates in a horizontal direction for conveying the tofu blocks above packaging packs;

a vertical drive device connected to the pair of grasp plates, and driving the pair of grasp plates in a vertical direction of the pair of grasp plates;

a conveyor for conveying the tofu blocks in the horizontal direction; and a vice-horizontal drive device arranged between the vertical drive device and the pair of grasp plates, to open and close the pair of grasp plates;

wherein the pair of grasp plates is arranged to grasp the tofu blocks cut to a predetermined size to move the tofu blocks to predetermined positions above the packaging packs, and to release the tofu blocks and pack the tofu blocks in the packaging packs, or, to maintain grasping of the tofu blocks so that weights of the tofu blocks cause the tofu blocks to drop from the pair of grasp plates due to gravity and pack the tofu blocks in the packaging packs, the vertical drive device is arranged to move the pair of grasp plates in the vertical direction between an upper position in which the pair of grasp plates is positioned not to grasp the tofu blocks, and a lower position in which the pair of grasp plates is positioned to grasp the tofu blocks, the horizontal drive device is arranged to move the pair of grasp plates in the horizontal direction between an end portion of the conveyor to grasp the tofu blocks, and the predetermined position above the packaging packs to drop and pack the tofu blocks, the pair of grasp plates is arranged so that when the conveyor conveys the tofu blocks to the end portion of the conveyor, the vertical drive device moves the pair of grasp plates to the lower position to grasp the tofu blocks, and the horizontal drive device moves the pair of grasp plates to the predetermined position above the packing packs and drops the tofu blocks in the packaging packs to pack, and when the pair of grasp plates grasps the tofu blocks and the horizontal drive device moves the pair of grasp plates to the predetermined position above the packaging packs, the vice-horizontal drive device drives the pair of grasp plates to move away from each other and to drop the tofu blocks in the packaging packs to pack.

7. A tofu packing apparatus according to claim 6, wherein the pair of grasp plates has at least one spacer plate therebetween so that tofu blocks are grasped between one of the pair of grasp plates and the spacer plate, and between another of the pair of grasp plates and the spacer plate.

8. A tofu packing apparatus according to claim 7, wherein the vice-horizontal drive device includes a first vice-horizontal motion cylinder disposed between said one of the pair of grasp plates and the spacer plate, and a second vice-horizontal motion cylinder connected to said another of the pair of grasp plates, and the vertical drive device includes a first vertical motion cylinder connected to the first vice-horizontal motion cylinder, and a second vertical motion cylinder connected to the second vice-horizontal motion cylinder so that when the conveyor conveys the tofu blocks to the end portion of the conveyor, the second vertical motion cylinder moves said another of the pair grasp plates to the lower position to support the tofu blocks from a downstream side of the conveyor and the first vertical motion cylinder moves said one of the pair of grasp plates and the spacer plate to the lower position thereafter to grasp the tofu blocks, and the horizontal drive device moves the pair of grasp plates to the predetermined position above the packing packs and drops the tofu blocks in the packaging packs to pack.

9. A tofu packing apparatus according to claim 8, further comprising:

a shutter plate disposed at a position downstream of the conveyor and above the package packs, for receiving the tofu blocks at the predetermined position, and retracting from the predetermined position to drop the tofu blocks into the package packs.

* * * * *